US012405015B2

(12) United States Patent
Kim et al.

(10) Patent No.: US 12,405,015 B2
(45) Date of Patent: Sep. 2, 2025

(54) DEHUMIDIFICATION APPARATUS AND DEHUMIDIFICATION METHOD USING THE SAME

(71) Applicant: Samsung Electronics Co., Ltd., Suwon-si (KR)

(72) Inventors: Minsoo Kim, Suwon-si (KR); Joongwon Na, Suwon-si (KR); Kookjeong Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 424 days.

(21) Appl. No.: 17/661,149

(22) Filed: Apr. 28, 2022

(65) Prior Publication Data

US 2022/0412579 A1 Dec. 29, 2022

Related U.S. Application Data

(63) Continuation of application No. PCT/KR2022/005296, filed on Apr. 12, 2022.

(30) Foreign Application Priority Data

Jun. 29, 2021 (KR) ..... 10-2021-0085021

(51) Int. Cl.
*F24F 3/153* (2006.01)
*F24F 11/72* (2018.01)

(52) U.S. Cl.
CPC ..... *F24F 3/153* (2013.01); *F24F 11/72* (2018.01)

(58) Field of Classification Search
CPC . F24F 3/153; F24F 11/72; F25B 30/02; A47L 23/205; A47L 23/18
See application file for complete search history.

(56) References Cited

U.S. PATENT DOCUMENTS 9,976,242 B2 5/2018 Ryoo et al.
2005/0086824 A1 4/2005 Ono et al.
(Continued)

FOREIGN PATENT DOCUMENTS

DE 4306217 A1 * 9/1994 ..... D06F 58/02
EP 2765235 A1 8/2014
(Continued)

OTHER PUBLICATIONS

DE-4306217-A1 translation.*
(Continued)

*Primary Examiner* — Elizabeth J Martin

(57) ABSTRACT

Provided is a dehumidification apparatus including: a storage compartment that provides an accommodation space; a circulation blower that forms an air current flowing along a circulation path connected to the accommodation space; a heat pump that exchanges heat with the air current flowing along the circulation path; and an air current diverter, wherein the heat pump includes: a first heat exchanger that absorbs heat from the air current; and a second heat exchanger that releases heat, wherein the circulation path includes a first circulation path in which the air current passes through the second heat exchanger to the accommodation space and a second circulation path in which the air current passed through the first heat exchanger is allowed to bypass the second heat exchanger and flow to the accommodation space, and wherein the air current diverter diverts the circulation path from the first circulation path to the second circulation path.

18 Claims, 19 Drawing Sheets

(56) References Cited

U.S. PATENT DOCUMENTS

| | | | | |
|---|---|---|---|---|
| 2007/0157660 | A1 | 7/2007 | Lee et al. | |
| 2016/0160419 | A1* | 6/2016 | Ryoo | D06F 25/00 68/12.14 |
| 2020/0040504 | A1 | 2/2020 | Rochford et al. | |
| 2021/0093743 | A1 | 4/2021 | Kim et al. | |
| 2021/0401266 | A1* | 12/2021 | Yoo | A61L 2/26 |
| 2024/0260810 | A1* | 8/2024 | Kim | A61L 2/07 |

FOREIGN PATENT DOCUMENTS

| | | | |
|---|---|---|---|
| JP | 2005024113 | A | 1/2005 |
| JP | 2011-092329 | A | 5/2011 |
| JP | 2014-090944 | A | 5/2014 |
| JP | 2014-150859 | A | 8/2014 |
| KR | 100565677 | B1 | 3/2006 |
| KR | 100624023 | B1 | 9/2006 |
| KR | 20070074301 | A | 7/2007 |
| KR | 10-2010-0067751 | A | 6/2010 |
| KR | 10-2015-0117431 | A | 10/2015 |
| KR | 10-1613963 | B1 | 4/2016 |
| KR | 10-2021-0016968 | A | 2/2021 |
| KR | 10-2021-0016974 | A | 2/2021 |
| KR | 10-2021-0017015 | A | 2/2021 |
| KR | 10-2230674 | B1 | 3/2021 |
| KR | 102246320 | B1 | 4/2021 |
| KR | 20210038161 | A | 4/2021 |
| KR | 102496520 | B1 | 2/2023 |

OTHER PUBLICATIONS

International Search Report dated Aug. 3, 2022 in connection with International Patent Application No. PCT/KR2022/005296, 4 pages.
Written Opinion of the International Searching Authority dated Aug. 3, 2022 in connection with International Patent Application No. PCT/KR2022/005296, 5 pages.
Office Action issued Mar. 14, 2025, in connection with Korean Patent Application No. 10-2021-0085021, 16 pages.

* cited by examiner

DEHUMIDIFICATION APPARATUS AND DEHUMIDIFICATION METHOD USING THE SAME

CROSS-REFERENCE TO RELATED APPLICATIONS

This application is a continuation of International Application No. PCT/KR2022/005296, filed Apr. 12, 2022, which is based on and claims priority under 35 U.S.C. § 119 to Korean Patent Application No. 10-2021-0085021, filed Jun. 29, 2021, in the Korean Intellectual Property Office, the disclosures of which are incorporated herein by reference in their entirety.

BACKGROUND

1. Field

The disclosure relates to a dehumidification apparatus and a dehumidification method using the same.

2. Description of the Related Art

A dehumidification apparatus is an apparatus for caring for and storing clothes and shoes worn by people, and in particular, maintaining shoes and the like in a pleasant state by controlling the humidity. Such a dehumidification apparatus may include a filter and a steamer for performing deodorization and sterilization on shoes, etc. disposed in the dehumidification apparatus. In the process of caring for shoes, etc., air discharged from inside the dehumidification apparatus to the outside may cause users to feel unpleasant due to the odor of the air. In addition, steam injected onto shoes, etc. in the dehumidification apparatus may sterilize shoes, and the like but may damage the shoes due to the high temperature of the steam.

SUMMARY

Therefore, it is an object of the disclosure to provide a dehumidification apparatus capable of controlling the dehumidifying temperature, and dehumidification method using the same.

The technical objectives of the disclosure are not limited to the above, and other objectives may become apparent to those of ordinary skill in the art based on the following descriptions.

According to an aspect of the disclosure, there is provided a dehumidification apparatus including: a storage compartment configured to provide an accommodation space; a circulation blower configured to form an internal air current flowing along a circulation path connected to the accommodation space; a heat pump configured to exchange heat with the internal air current moving along the circulation path; and an air current diverter, wherein the heat pump includes: a first heat exchanger configured to absorb heat from the internal air current; and a second heat exchanger configured to release heat to a surrounding, wherein the circulation path includes a first circulation path in which the internal air current passed through the first heat exchanger is allowed to pass through the second heat exchanger and flow to the accommodation space and a second circulation path in which the internal air current passed through the first heat exchanger is allowed to bypass the second heat exchanger and flow to the accommodation space, and wherein the air current diverter is configured to divert the circulation path from the first circulation path to the second circulation path.

According to an aspect of the disclosure, there is provided a dehumidification apparatus including: a storage compartment configured to provide an accommodation space; a circulation blower configured to form an internal air current flowing along a circulation path connected to the accommodation space; a heat pump configured to exchange heat with the internal air current moving along the circulation path, and includes an evaporator, a compressor, a condenser, an expansion valve, and a refrigerant pipe; an outdoor cooling blower configured to form an external air current in an outdoor air cooling path connected to an outdoor space; and a controller configured to control the outdoor air cooling blower, the internal air current introduced from the accommodation space sequentially passes through the evaporator and the condenser along the circulation path and returns to the accommodation space, and the controller is configured to select and perform at least one of: a first dehumidifying mode in which the external air current is transferred to the condenser to perform outdoor air cooling on the condenser; and a second dehumidifying mode in which the outdoor air cooling on the condenser using the external air current is stopped.

Other aspects of embodiments will become apparent from the following detailed description and the annexed drawings.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
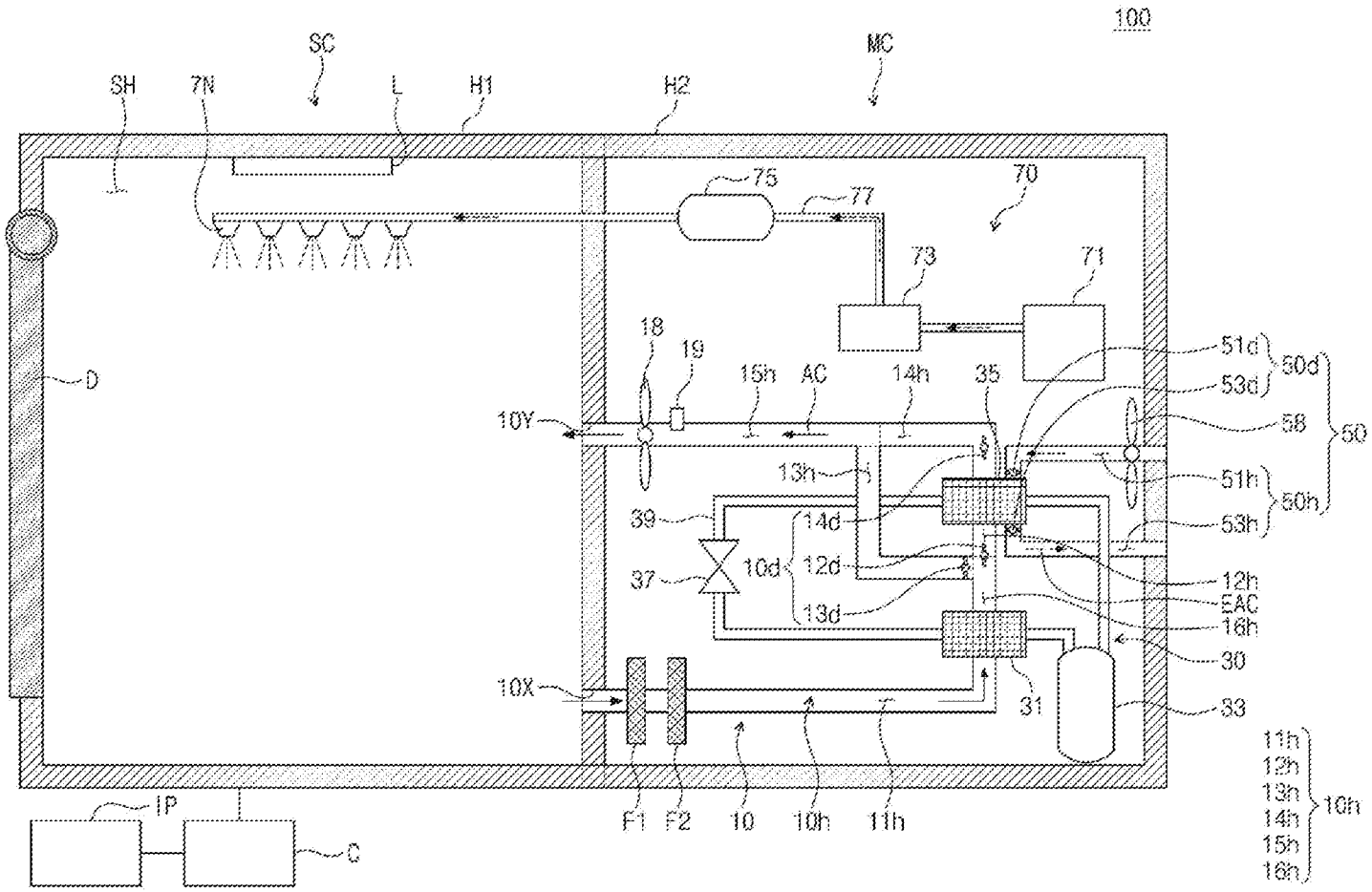
FIG. 1 is a schematic diagram illustrating a dehumidification apparatus according to embodiments of the disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device The embodiments set forth herein and illustrated in the configuration according to the disclosure are only the most preferred embodiments and are not representative of the full the technical spirit according to the disclosure, so it should be understood that they may be replaced with various equivalents and modifications at the time according to the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings according to the disclosure. Descriptions shall be understood as to include any and all combinations of one or more of the associated listed items when the items are described by using the conjunctive term "~ and/or ~," or the like.

Hereinafter, embodiments according to the disclosure will be described in detail with reference to the accompanying drawings.

FIG. 1 is a schematic diagram illustrating a dehumidification apparatus according to embodiments of the disclosure.

Referring to FIG. 1, a dehumidification apparatus 100 may be provided. The dehumidification apparatus 100 may be an apparatus for caring for and/or storing shoes and clothes. More specifically, the dehumidification apparatus 100 may be an apparatus for caring for shoes or the like or storing the shoes in a certain state, by performing deodorization, sterilization, and dehumidification operations on the shoes or the like. Hereinafter, for the sake of simplicity in description, a target for caring is described as a shoe, but the disclosure is not limited thereto, and other household items, such as clothing, may also be a target for caring.

The dehumidification apparatus 100 may include a storage compartment SC, a machine compartment MC, a controller C, and an inputter IP.

The storage compartment SC may be a place in which shoes are stored. The storage compartment SC may include a first housing H1, a door D, and a sterilization light source L.

The first housing H1 may form the external appearance of the storage compartment SC. The first housing H1 may provide an accommodation space SH. That is, the accommodation space SH may be defined by the first housing H1. Shoes may be stored in the accommodation space SH. That is, in a state in which shoes are stored in the accommodation space SH, care and storage of the shoes may be conducted.

The door D may be coupled to a side of the first housing H1. The door D may allow the accommodation space SH to be separated from or connected to the outdoor space. That is, when the door D is opened, the accommodation space SH may be exposed to the outside, and when the door D is closed, the accommodation space SH may be separated from the outside. When the door D is closed, the air in the accommodation space SH may be isolated from the air of the outdoor space. The user may open or close the door D to accommodate the shoes in the accommodation space SH or take out the shoes from the accommodation space SH.

The sterilization light source L may be coupled to an inner surface of the first housing H1. The sterilization light source L may perform a sterilization operation on the shoes accommodated in the accommodation space SH. To this end, the sterilization light source L may transmit ultraviolet rays. That is, the sterilization light source L may include an ultraviolet ray (UV) lamp. More specifically, the sterilization light source L may include a xenon (Xe) lamp. However, the disclosure is not limited thereto, and the sterilization light source L may include other light sources capable of sterilizing shoes in the accommodation space SH.

The machine compartment MC may include a mechanical device for caring for shoes in the storage compartment SC. For example, the machine compartment MC may include a second housing H2, a steamer 70, a heat pump 30, an air current circulator 10, and an outdoor air cooler 50.

The second housing H2 may form the external appearance of the machine compartment MC. The steamer 70, the heat pump 30, the air current circulator 10, the outdoor air cooler 50, and the like may be located inside the second housing H2. However, the disclosure is not limited thereto, and a portion of each of the steamer 70, the heat pump 30, the air current circulator 10, and the outdoor air cooler 50 may be located outside the second housing H2.

The steamer 70 may generate steam and spray the generated steam into the accommodation space SH. The steamer 70 may include a steam tank 71, a steam pipe 77, a steam generator 73, a steam compressor 75, and a steam injector 7N.

The steam tank 71 may store water for steam generation. Water in the steam tank 71 may need to be periodically filled. To this end, the steam tank 71 may be disposed in a place that may be easily accessed by a user. Details thereof will be described below.

The steam pipe 77 may connect the steam tank 71, the steam generator 73, the steam compressor 75, and the steam injector 7N. Water in the steam tank 71 may move along the steam pipe 77 to the steam generator 73.

The steam generator 73 may generate steam using water. For example, the steam generator 73 may heat water that has moved along the steam pipe 77 using a heating wire to generate steam. The generated steam may continue to move along the steam pipe 77.

The steam compressor 75 may provide the steam pipe 77 with a driving force. That is, the steam compressor 75 may allow the steam in the steam pipe 77 to be moved and injected through the steam injector 7N.

The steam injector 7N may inject the steam generated by the steam generator 73 into the accommodation space SH. To this end, the steam injector 7N may include one or more nozzles. The injector 7N may be provided in plural. The plurality of steam injectors 7N may be arranged adjacent to each other as shown in FIG. 1, but the arrangement is not limited thereto. That is, the plurality of steam injectors 7N may be spaced apart from each other to inject steam to various positions in the accommodation space SH. In the following description, unless otherwise specified, the steam injector 7N will be described in a single unit for the sake of convenience in description.

In the above, the steamer 70 has been described as generating and supplying steam by an instantaneous heating method, but the disclosure is not limited thereto. That is, unlike that shown in FIG. 1, the steamer 70 may generate steam in a water tank type heating method and supply the steam to the accommodation space SH.

When steam is injected into the accommodation space SH by the steamer 70, shoes disposed in the accommodation space SH may be steam sterilized and/or deodorized. More specifically, shoes in the accommodation space SH may be sterilized and/or deodorized by high-temperature steam. That is, the dehumidification apparatus 100 may provide a steam injecting mode for shoes.

The heat pump 30 may perform a cycle while exchanging heat with the outside. For example, the heat pump 30 may include a vapor compression refrigeration cycle in which a refrigerant circulates and heat-exchanges with surroundings. In this case, the heat pump 30 may include a refrigerant pipe 39, a first heat exchanger 31, a compressor 33, a second heat exchanger 35, and an expansion valve 37.

The refrigerant pipe 39 may refer to a pipe through which a refrigerant flows. The refrigerant in the refrigerant pipe 39 may be a working fluid of a refrigeration cycle. The type of the refrigerant may be selected in consideration of the range of temperature that may be required for dehumidification and deodorization. The refrigerant pipe 39 may connect the first heat exchanger 31, the compressor 33, the second heat exchanger 35, and the expansion valve 37. The refrigerant may move along the refrigerant pipe 39 and sequentially pass through the first heat exchanger 31, the compressor 33, the second heat exchanger 35, and the expansion valve 37. Details thereof will be described below with reference to FIG. 7.

The first heat exchanger 31 may absorb heat from the surroundings. More specifically, the first heat exchanger 31 may absorb heat from the surroundings, and a refrigerant passing through the first heat exchanger 31 may absorb heat from the first heat exchanger 31. The refrigerant in a liquid state and passing through the first heat exchanger 31 may absorb heat from the first heat exchanger 31 to become a gaseous refrigerant. That is, the first heat exchanger 31 may be an evaporator.

The compressor 33 may compress the refrigerant that has passed through the first heat exchanger 31 into a high temperature and high pressure refrigerant. More specifically, a low-temperature and low-pressure gas refrigerant that passed through the first heat exchanger 31 may be converted into a high-temperature and high-pressure gas by the compressor 33. To this end, the compressor 33 may be supplied with power from the outside. By the power transmitted from the outside, the refrigerant passing through the compressor 33 may be compressed. The compressor 33 may include a constant speed compressor or an inverter compressor. The type of the compressor 33 may be selected in consideration of the type of the refrigerant and required temperature and pressure conditions.

The second heat exchanger 35 may release heat to the surroundings. More specifically, the refrigerant passing through the second heat exchanger 35 may transfer heat to the second heat exchanger 35, and the second heat exchanger 35 may release heat to the surroundings. The gaseous refrigerant passing through the second heat exchanger 35 may transfer heat to the second heat exchanger 35 to become a liquid refrigerant. That is, the second heat exchanger 35 may be a condenser. A high-temperature and high-pressure gas refrigerant passing through the second heat exchanger 35 may release heat to become a low-temperature and high-pressure liquid refrigerant. Details thereof will be described below.

The expansion valve 37 may expand the refrigerant that has passed through the second heat exchanger 35 into a low temperature and a low pressure refrigerant. More specifically, a low-temperature and high-pressure liquid refrigerant that has passed through the second heat exchanger 35 may be converted into a low-temperature and low-pressure fluid by the expansion valve 37. The refrigerant passed through the expansion valve 37 may be a two-phase refrigerant in which liquid and gas are mixed. However, the disclosure is not limited thereto, and the refrigerant passed through the expansion valve 37 may be a one-phase refrigerant in a completely liquid state. The refrigerant passed through the expansion valve 37 may return to the first heat exchanger 31 along the refrigerant pipe 39.

Although the heat pump 30 has been described as performing a vapor compression type refrigeration cycle using a refrigerant, the disclosure is not limited thereto. For example, unlike the description shown in FIG. 1, the heat pump 30 may be a thermoelectric element using the Peltier effect. In this case, the first heat exchanger 31 may not be an evaporator. In addition, the second heat exchanger 35 may not be a condenser. The compressor 33, the expansion valve 37, the refrigerant pipe 39, or the like may be omitted. Alternatively, the heat pump 30 may be configured to perform a refrigeration cycle different from that described above.

The air current circulator 10 may circulate air in the accommodation space SH. More specifically, the air current circulator 10 may circulate the air in the accommodation space SH to the outside of the accommodation space SH, and dehumidify the circulated air. To this end, the air current circulator 10 may provide a circulation path 10*h*. The circulation path 10*h* may be a path connected to the accommodation space SH and located outside the accommodation space SH. Air in the accommodation space SH may be introduced into the circulation path 10*h* through an inlet 10X. Hereinafter, air flowing into the circulation path 10*h* and moving may be referred to as an internal air current AC. The term "air current" used herein may refer to air flowing in a certain direction. In addition, the internal air current on the circulation path 10*h* may flow out into the accommodation space SH through an outlet 10Y. The air current circulator 10 may exchange heat with the heat pump 30 between the inlet 10X and the outlet 10Y. That is, the internal air current on the circulation path 10*h* may exchange heat with the heat pump 30. When the heat pump 30 forms a vapor compression cycle using a refrigerant, the internal air current on the circulation path 10*h* may exchange heat with a refrigerant that is a working fluid of the heat pump 30. To this end, parts of the circulation path 10*h* may overlap parts of the heat pump 30.

For example, a part of the circulation path 10*h* may overlap the first heat exchanger 31. When the circulation path 10*h* is referred to as overlapping the first heat exchanger 31, the circulation path 10*h* may overlap the surrounding space of components constituting the first heat exchanger 31. Accordingly, the internal air current on the circulation path 10*h* may be introduced into the first heat exchanger 31. When the internal air current is referred to as being introduced into the first heat exchanger 31, the internal air current moving along the circulation path 10*h* approaches the surroundings of the first heat exchanger 31 such that heat transfer between the internal air current and the first heat exchanger 31 is performable. The internal air current on the circulation path 10*h* may release heat to the first heat exchanger 31. That is, the first heat exchanger 31 may absorb heat from the internal air current on the circulation path 10*h*. When the internal air current on the circulation path 10*h* approaches the first heat exchanger 31, releases heat to the first heat exchanger 31, and then moves away from the first heat exchanger 31, the internal air current is referred to as passing through the first heat exchanger 31.

In addition, a part of the circulation path 10*h* may overlap the second heat exchanger 35. When the circulation path 10*h* is referred to as overlapping the second heat exchanger 35, the circulation path 10*h* may overlap the surrounding space of components constituting the second heat exchanger 35. Accordingly, the internal air current on the circulation path 10*h* that passed through the first heat exchanger 31 may be introduced into the second heat exchanger 35. When the internal air current is referred to as being introduced into the second heat exchanger 35, the internal air current moving along the circulation path 10*h* approaches the surroundings of the second heat exchanger 35 such that heat transfer between the internal air current and the second heat exchanger 35 is performable. The internal air current on the circulation path 10*h* may absorb heat from the second heat exchanger 35. That is, the second heat exchanger 35 may release heat to the internal air current on the circulation path 10*h*. When the internal air current on the circulation path 10*h* approaches the second heat exchanger 35, absorbs heat from the second heat exchanger 35, and then moves away from the second heat exchanger 35, the internal air current may be referred to as passing through the second heat exchanger 35.

Alternatively, a part of the circulation path 10*h* may bypass the second heat exchanger 35. That is, a part of the circulation path 10*h* passed through the first heat exchanger 31 may be formed to bypass the second heat exchanger 35 and connect to the accommodation space SH. Accordingly, in this case, the internal air current on the circulation path 10*h* may exchange heat only with the first heat exchanger 31 without exchanging heat with the second heat exchanger 35. That is, the air current circulator 10 may allow the internal air current to pass through the second heat exchanger 35 or bypass the second heat exchanger 35 before returning to the accommodation space SH, thereby adjusting the temperature of the internal air current returning to the accommodation space SH. Hereinafter, an example of the circulation path 10*h* for the above-function will be described in detail.

The circulation path 10*h* may include a first heat exchange path 11*h*, a first connection path 16*h*, a second heat exchange path 12*h*, a bypass path 13*h*, a second connection path 14*h*, and an outlet path 15*h*.

The first heat exchange path 11*h* may connect the accommodation space SH to the first heat exchanger 31. Air in the accommodation space SH may pass through the inlet 10X and may move along the first heat exchange path 11*h* to the first heat exchanger 31. The internal air current on the circulation path 10*h*, while passing through the first heat exchanger 31, may release heat to the first heat exchanger 31. Accordingly, the internal air current, while passing through the first heat exchanger 31, may decrease in temperature. More specifically, the temperature of the internal air current passing through the first heat exchanger 31 may be lowered below the dew point. For example, the internal air current passed through the first heat exchanger 31 may have a decrease in temperature up to about 0 degrees Celsius to about 15 degrees Celsius. Accordingly, water vapor in the internal air current passing through the first heat exchanger 31 may be condensed. Accordingly, the absolute humidity of the internal air current passed through the first heat exchanger 31 may be lowered. That is, the internal air current passed through the first heat exchanger 31 may be dehumidified. In addition, by dehumidifying the internal air current on the circulation path 10*h*, a deodorizing effect may also occur. The water vapor condensed in the first heat exchanger 31 may be discharged to a discharge tank. Details thereof will be described below.

The first connection path 16*h* may connect the first heat exchanger 31 to the second heat exchange path 12*h* and the bypass path 13*h*. That is, the internal air current passed through the first heat exchanger 31 may move along the first connection path 16*h* to the second heat exchange path 12*h* or the bypass path 13*h*.

The second heat exchange path 12*h* may connect the first connection path 16*h* to the second heat exchanger 35. The second heat exchange path 12*h* may be referred to as a first circulation path. The internal air current passed through the first heat exchanger 31 may move along the second heat exchange path 12*h* to the second heat exchanger 35. The internal air current passing through the second heat exchanger 35 on the circulation path 10*h* may absorb heat from the second heat exchanger 35. Accordingly, the internal air current on the circulation path 10*h*, while passing through the second heat exchanger 35, may increase in temperature. For example, the internal air current passed through the second heat exchanger 35 may have an increase in temperature up to about 25 degrees Celsius to about 40 degrees Celsius.

The bypass path 13*h* may connect the first connection path 16*h* to the outlet path 15*h*. That is, the bypass path 13*h* may bypass the second heat exchanger 35 such that the internal air current passed through the first heat exchanger 31 returns to the accommodation space SH without exchanging heat with the second heat exchanger 35. Accordingly, the internal air current passed through the first heat exchanger 31 may bypass the second heat exchanger 35 along the bypass path 13*h*. Hereinafter, the bypass path 13*h* may be referred to as a second circulation path.

The second connection path 14*h* may connect the second heat exchanger 35 to the outlet path 15*h*. That is, the internal air current passed through the second heat exchanger 35 may move along the second connection path 14*h* to the outlet path 15*h*.

The outlet path 15*h* may connect the bypass path 13*h* and the second connection path 14*h* to the accommodation space SH. The internal air current that has moved along the bypass path 13*h* and the second connection path 14*h* may return to the accommodation space SH along the outlet path 15*h*.

The circulation path 10*h* described above may be provided by a duct or the like. That is, each of the first heat exchange path 11*h*, the first connection path 16*h*, the second heat exchange path 12*h*, the bypass path 13*h*, the second connection path 14*h*, and the outlet path 15*h* may be defined by a duct. Details thereof will be described below with reference to FIGS. 7 to 9B.

The air current circulator 10 may include an air current diverter 10*d*, a first filter F1, a second filter F2, a temperature sensor 19, and a circulation blower 18.

The air current diverter 10*d* may adjust the direction of the internal air current on the circulation path 10*h*. That is, the air current diverter 10*d* may adjust the movement direction of the internal air current to transport the internal air current to a specific path. For example, the air current diverter 10*d* may allow the internal air current passed through the first heat exchanger 31 to move to the second heat exchanger 35 or bypass the second heat exchanger 35. More specifically, the air current diverter 10*d* may allow the internal air current on the first connection path 16*h* to be transported to the second heat exchange path 12*h* or to the bypass path 13*h*. By operations of the air current diverter 10*d*, the internal air current on the circulation path 10*h* may enter or bypass the second heat exchanger 35 before returning to the accommodation space SH. The air current diverter 10*d* may include a component for transporting the internal air current passed through the first heat exchanger 31 to one of the second heat exchange path 12*h* and the bypass path 13*h*. For example, the air current diverter 10*d* may include a damper. More specifically, the air current diverter 10*d* may include a first damper 12*d*, a second damper 13*d*, and a fourth damper 14*d*.

The first damper 12*d* may adjust the internal air current between the first heat exchanger 31 and the second heat exchange path 12*h*. For example, the first damper 12*d* may be located in the second heat exchange path 12*h* to allow or block the internal air current on the first connection path 16*h* transported toward the second heat exchange path 12*h*. That is, when the first damper 12*d* is opened, the internal air current on the first connection path 16*h* may flow into the second heat exchange path 12*h*. Conversely, when the first damper 12*d* is closed, the internal air current on the first connection path 16*h* may not flow into the second heat exchange path 12*h*. In addition, the first damper 12*d* may prevent the external air current in the outdoor air cooler 50 from flowing into the accommodation space SH through the second heat exchanger 35.

The second damper 13*d* may adjust the internal air current between the first heat exchanger 31 and the bypass path 13*h*. For example, the second damper 13*d* may be located in the bypass path 13*h* to allow or block the internal air current on the first connection path 16*h* transported toward the bypass path 13*h*. That is, when the second damper 13*d* is opened, the internal air current on the first connection path 16*h* may flow into the bypass path 13*h*. Conversely, when the second damper 13*d* is closed, the internal air current on the first connection path 16*h* may not flow into the bypass path 13*h*.

The fourth damper 14*d* may be located in the second connection path 14*h*. The fourth damper 14*d* may prevent the internal air current, which has bypassed the second heat exchanger 35 along the bypass path 13*h*, from flowing backward to the second heat exchanger 35 along the second connection path 14*h*. In addition, the fourth damper 14*d* may prevent the external air current in the outdoor air cooler 50 from flowing into the accommodation space SH through the second heat exchanger 35. That is, each of the first damper 12*d* and the second damper 13*d* may block the inflow of the external air current into the accommodation space SH. Details thereof will be described below.

Although the air current diverter 10*d* is illustrated as including three dampers, the disclosure is not limited thereto. For example, only one damper may exist between the second heat exchange path 12*h* and the bypass path 13*h* unlike shown in FIG. 1. That is, the internal air current passed through the first heat exchanger 31 may be allowed to flow through one of the second heat exchange path 12*h* and the bypass path 13*h* using a single damper according to a selection. In addition, although the air current diverter 10*d* has be described as having a damper shape, the disclosure is not limited thereto. That is, unlike that shown in FIG. 1, the air current diverter 10*d* may include another type of configuration capable of changing the direction of the internal air current on the circulation path 10*h*.

The first filter F1 may filter the internal air current on the circulation path 10*h*. For example, the first filter F1 may include a dust filter to filter out particulate matter, such as dust, in the internal air current passing through the first filter F1. The first filter F1 may be located on the circulation path 10*h*. Alternatively, the first filter F1 may be located between the circulation path 10*h* and the accommodation space SH. The first filter F1 may need to be replaced periodically. To this end, the first filter F1 may be disposed in a place that may be easily accessed by a user. Details thereof will be described below.

The second filter F2 may filter the internal air current on the circulation path 10*h*. For example, the second filter F2 may include a photo-catalyst filter to filter out odor-causing substances in the internal air current passing through the second filter F2. Therefore, the dehumidification apparatus 100 for deodorization and dehumidification according to the disclosure may not only provide the deodorization effect by steam and/or dehumidification, but also the deodorization effect by the second filter F2. The second filter F2 may be located on the circulation path 10*h*. Alternatively, the second filter F2 may be located between the circulation path 10*h* and the accommodation space SH. The lifetime of the second filter F2 may be relatively long. For example, the second filter F2 may be used semi-permanently. However, the disclosure is not limited thereto, and the second filter F2 may also need to be periodically replaced, similar to the first filter F1.

The temperature sensor 19 may measure the temperature of the internal air current. The temperature sensor 19 may be disposed on the circulation path 10*h*. For example, the temperature sensor 19 may be disposed on the outlet path 15*h*. The temperature sensor 19 may measure the temperature of the internal air current returning to the accommodation space SH through the outlet path 15*h*.

The circulation blower 18 may provide the circulation path 10*h* with a driving force of an internal air current. That is, the circulation blower 18 may generate an internal air current in the circulation path 10*h*. More specifically, the circulation blower 18 may cause the air in the accommodation space SH to move to the circulation path 10*h* and form an internal air current. The circulation blower 18 may be located on the outlet path 15*h*, but is not limited thereto. The circulation blower 18 may include a blowing fan. In this case, the circulation blower 18 may generate an internal air current in the circulation path 10*h* by rotation of the fan.

The outdoor air cooler 50 may be connected to the second heat exchanger 35. More specifically, the outdoor air cooler 50 may be connected to the second heat exchanger 35 to cool the second heat exchanger 35 using an external air current. The outdoor air cooler 50 may include an outdoor air cooling path 50*h*, an outdoor air damper 50*d*, and an outdoor air cooling blower 58.

The outdoor air cooling path 50*h* may connect the second heat exchanger 35 to the outdoor space. More specifically, the outdoor air cooling path 50*h* may refer to a path connecting the second heat exchanger 35 to a space outside the dehumidification apparatus 100. A part of the outdoor air cooling path 50*h* may overlap the second heat exchanger 35. Accordingly, outdoor air may enter the space around the second heat exchanger 35 through the outdoor air cooling path 50*h*. When the above-described outdoor air cooler 50 is referred to as being connected to the second heat exchanger 35, the outdoor air cooling path 50*h* provided by the outdoor air cooler 50 may partially overlap the second heat exchanger 35. Details thereof will be described below. The outdoor air cooling path 50*h* may include an outdoor air inlet path 51*h* and an outdoor air outlet path 53*h*. Outdoor air may be transferred to the second heat exchanger 35 along the outdoor air inlet path 51*h*. Hereinafter, the air flowing into and through the outdoor air cooling path 50*h* may be referred to as an external air current (EAC). The external air current cooled by the second heat exchanger 35 may return to the outdoor space along the outdoor air outlet path 53*h*.

The outdoor air damper 50*d* may adjust the external air current between the second heat exchanger 35 and the outdoor air cooling path 50*h*. The outdoor air damper 50*d* may be referred to as a third damper. The outdoor air damper 50*d* may include a first outdoor air damper 51*d* and a second outdoor air damper 53*d*. The first outdoor air damper 51*d* may be located on the outdoor air inlet path 51*h*. The second outdoor air damper 53*d* may be located on the outdoor air outlet path 53*h*. When the first outdoor air damper 51*d* and the second outdoor air damper 53*d* are opened, the second heat exchanger 35 may be connected to the outdoor space. When the first outdoor air damper 51*d* and the second outdoor air damper 53*d* are closed, the second heat exchanger 35 may be blocked from the outdoor space.

The outdoor air cooling blower 58 may provide the outdoor air cooling path 50*h* with a driving force of an external air current. That is, the outdoor air cooling blower 58 may generate an external air current in the outdoor air cooling path 50*h*. The outdoor air cooling blower 58 may be located on the outdoor air inlet path 51*h*, but is not limited thereto. The outdoor air cooling blower 58 may include a blowing fan. In this case, the outdoor air cooling blower 58 may generate an external air current in the outdoor air cooling path 50*h* by rotation of the fan.

The controller C may include a memory and a processor. The memory may be an integrated circuit (IC) chip that stores programs, instructions, and data for the operation of the dehumidification apparatus 100. The processor may generate a control signal for controlling the operation of the dehumidification apparatus 100 based on the program, instruction, and data stored in the memory. The memory and the processor may be mounted on a printed circuit board (PCB). The PCB may be located in a machine compartment (MC), but the disclosure is not limited thereto. The controller C may control the dehumidification apparatus 100. More specifically, the controller C may control the air current diverter 10*d*, the compressor 33, the circulation blower 18, the outdoor air cooling blower 58, the outdoor air damper 50*d*, a steam compressor 75, a steam generator 73, and the like.

For example, when the controller C closes the first damper 12*d* and the fourth damper 14*d* and opens the second damper 13*d*, the internal air current passed through the first heat exchanger 31 may bypass the second heat exchanger 35 and return to the accommodation space SH. The internal air current bypassed the second heat exchanger 35 may return to the accommodation space SH along the outlet path 15*h*. The air returned to the accommodation space SH may have a lower temperature state as a result of bypassing the second heat exchanger 35. In this case, the air supplied to the accommodation space SH through the circulation path 10*h* may be low-temperature and low-humidity air. An operation mode of the controller C controlling the dehumidification apparatus 100 under such conditions may be referred to as a first dehumidifying mode.

In the first dehumidifying mode, the controller C may open the first outdoor air damper 51*d* and the second outdoor air damper 53*d*. When the first outdoor air damper 51*d* and the second outdoor air damper 53*d* are opened, the external air current may move to the second heat exchanger 35.

Alternatively, when the controller C opens the first outdoor air damper 51*d* and the second outdoor air damper 53*d*, and further operates the outdoor air cooling blower 58, a larger amount of external air current flows to the second heat exchanger 35. The second heat exchanger 35 may release heat to the external air current. Accordingly, a refrigerant passing through the second heat exchanger 35 may be cooled by the external air current. Because the internal air current on the circulation path 10*h* in the first dehumidifying mode bypasses the second heat exchanger 35, a refrigerant in the second heat exchanger 35 may not release heat to the internal air current on the circulation path 10*h*. In this case, in order to cool the refrigerant in the second heat exchanger 35, the controller C may open the first outdoor air damper 51*d* and the second outdoor air damper 53*d*. When the first outdoor air damper 51*d* and the second outdoor air damper 53*d* are opened, an external air current may be introduced into the second heat exchanger 35. That is, the second heat exchanger 35 may be cooled by the external air current. Accordingly, even when the internal air current on the circulation path 10*h* bypasses the second heat exchanger 35, the refrigerant passing through the second heat exchanger 35 may release heat, so that the refrigeration cycle may continue. Because, in the first dehumidifying mode, the first damper 12*d* and the fourth damper 14*d* are in a closed state, the external air current introduced into the second heat exchanger 35 through the outdoor air cooling path 50*h* may be prevented from flowing into the accommodation space SH, or conversely, the air in the accommodation space SH may be prevented from escaping to the outside. Accordingly, odors generated from shoes disposed in the accommodation space SH may be prevented from leaking to the outside of the dehumidification apparatus 100.

In addition, when the controller C opens the first damper 12*d* and the fourth damper 14*d* and closes the second damper 13*d*, the internal air current passed through the first heat exchanger 31 may be introduced into the second heat exchanger 35. The internal air current on the circulation path 10*h* may absorb heat from the second heat exchanger 35, and thus have a relatively high temperature. The internal air current passed through the second heat exchanger 35 may return to the accommodation space SH along the outlet path 15*h*. In this case, the air supplied to the accommodation space SH through the circulation path 10*h* may be relatively high in temperature and low in humidity. An operation mode of the controller C controlling the dehumidification apparatus 100 under such conditions may be referred to as a second dehumidifying mode.

In addition, the controller C may control components required to be controlled in the dehumidification apparatus 100 to turn on/off devices or adjust outputs. In addition, the controller C may receive information about the temperature of the internal air current from the temperature sensor 19. More specifically, the controller C may receive information about the temperature of the internal air current returning to the accommodation space SH from the temperature sensor 19. The controller C may determine whether to perform the first dehumidifying mode or the second dehumidifying mode based on the information about the temperature of the internal air current returning to the accommodation space SH. Details thereof will be described below. With such operations of the controller C, the steam injection mode, the first dehumidifying mode, and/or the second dehumidifying mode may be performed.

The inputter IP may include an input device for a user to control the dehumidification apparatus 100. For example, the inputter IP may include a touchable display. The user may manipulate the dehumidification apparatus 100 by inputting a command to the controller C through the inputter IP.

When the steam injection mode is performed, the humidity of the accommodation space SH may rise very high. In addition, when the steam injection mode is performed, the temperature of the accommodation space SH may also rise very high due to the high-temperature steam. Shoes stored in the accommodation space SH may be vulnerable to high temperatures. Therefore, after sterilizing by injecting steam to shoes in the accommodation space SH, there may a need to lower the temperature of the accommodation space SH. To this end, the first dehumidifying mode may lower the humidity and temperature of the air in the accommodation space SH. Because in the first dehumidifying mode, the internal air current on the circulation path 10*h* bypasses the second heat exchanger 35, the internal air current may be supplied to the accommodation space SH in a fairly low temperature state. Accordingly, the accommodation space SH, the temperature of which has risen due to the high-temperature steam, may be rapidly cooled. Accordingly, the shoes in the accommodation space SH may be prevented from being damaged due to the high temperature. In addition, because the temperature is rapidly lowered using the first dehumidifying mode, the stroke time of the dehumidification apparatus 100 may be shortened. Accordingly, the user may rapidly care for shoes.

When the first dehumidifying mode is performed and thus the temperature of the accommodation space SH is sufficiently lowered, the controller C may perform the second dehumidifying mode. In the second dehumidifying mode, the accommodation space SH may be supplied with air having a temperature higher than with the first dehumidifying mode. More specifically, due to the air supplied in the second dehumidifying mode, the temperature of the accommodation space SH may be maintained at a level suitable for storage of shoes.

The dehumidification apparatus 100 according to embodiments of the disclosure may control the temperature of the air supplied to the accommodation space SH by bypassing the second heat exchanger 35. That is, the temperature of the dehumidified air may be adjusted without a need to control on/off of the compressor 33. It may take a long time to turn on/off of the compressor 33. For example, even when the compressor 33 is turned off, heat release of the second heat exchanger 35 may not immediately stop. In addition, even when the compressor 33 is turned on, a great amount of heat may not be immediately released from the second heat exchanger 35. Therefore, it may take a lot of time to control the dehumidification temperature through on/off operations of the compressor 33. Furthermore, repeated on/off operations of the compressor 33 may apply a load to the compressor 33, which may shorten the lifespan of the compressor 33. Moreover, when the compressor 33 is turned off, the heat absorbed by the first heat exchanger 31 is also reduced or eliminated, so that the dehumidifying effect on the internal air current in the first heat exchanger 31 may be reduced or eliminated. On the other hand, the dehumidification apparatus 100 according to the disclosure may control the dehumidification temperature by selectively bypassing the second heat exchanger as required, while the compressor 33 is continuously operated. Therefore, immediate temperature control of the internal air current may be performable, which benefits the care of shoes, and shorten the stroke time. In addition, the lifespan of the compressor may be extended. Furthermore, because the dehumidifying effect of the first heat exchanger 31 is maintained, the dehumidifying performance of the accommodation space SH may be improved.

Even in a case of using an inverter compressor, the speed of dehumidification temperature control may be limited. In addition, adjusting the output of the inverter compressor may lead to a change in the amount of heat absorbed by the first heat exchanger 31, so that the dehumidifying effect of the first heat exchanger 31 also changes. On the other hand, the dehumidification apparatus 100 according to the disclosure may use a method of bypassing the second heat exchanger 35 rather than a method of controlling the compressor 33, and thus improve the speed of dehumidification temperature control, which is insufficient for the inverter compressor, and further maintain the dehumidification performance of the first heat exchanger 31 in a constant level.

In the above, the configuration of the dehumidification apparatus 100 according to the disclosure has been briefly described with reference to FIG. 1. Hereinafter, embodiments in which the dehumidification apparatus 100 according to the disclosure is applied to a specific product will be described with reference to FIGS. 2 to 10.

Figure 2:
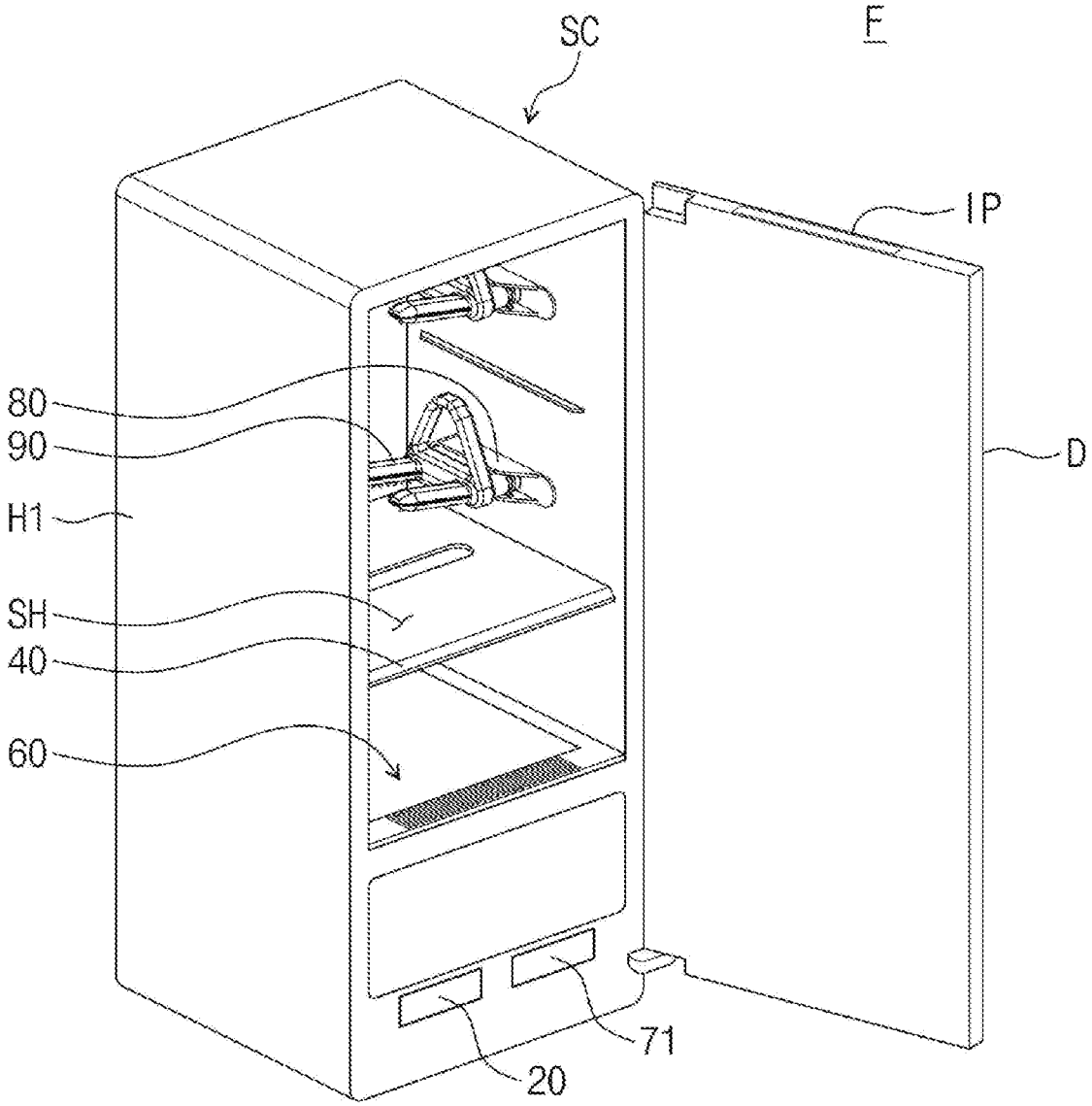
FIG. 2 is a perspective view illustrating a dehumidification apparatus according to embodiments of the disclosure.
Figure 3:
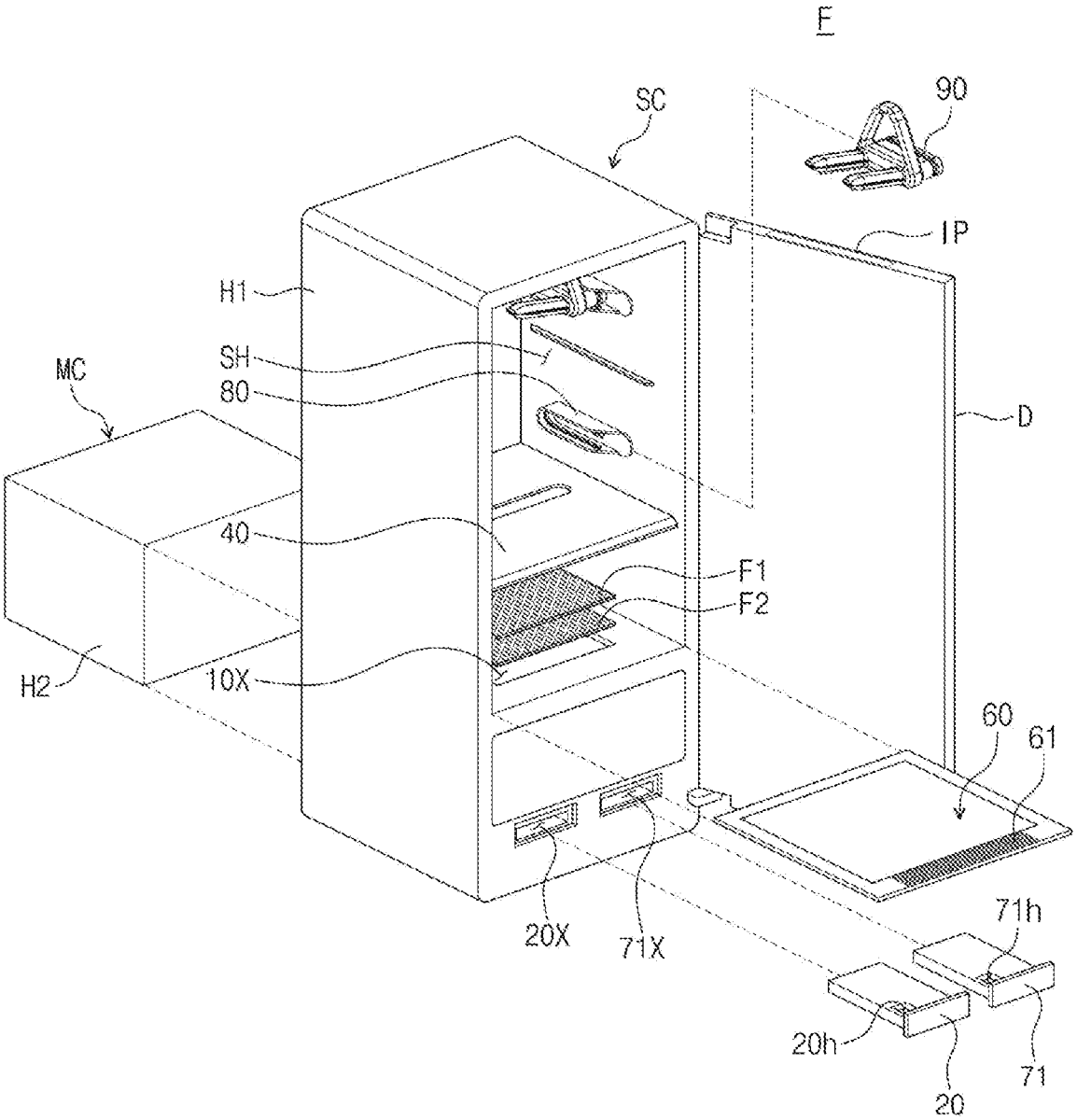
FIG. 3 is a partially exploded perspective view illustrating a dehumidification apparatus according to embodiments of the disclosure.

FIG. 2 is a perspective view illustrating a dehumidification apparatus according to embodiments of the disclosure, and FIG. 3 is a partially exploded perspective view illustrating a dehumidification apparatus according to embodiments of the disclosure.

In the following description, components that are substantially the same as or similar to those described with reference to FIG. 1 may be omitted, or described in brief, for the sake of convenience in description.

Referring to FIGS. 2 and 3, a shoe care apparatus F may be provided. The shoe care apparatus F shown in FIG. 2 may represent an embodiment of the dehumidification apparatus 100 (refer to FIG. 1) described with reference to FIG. 1. The shoe care apparatus F may be an apparatus that cares for and/or stores shoes. The shoe care apparatus F may perform steam sterilization, dehumidification, and deodorization on shoes. The shoe care apparatus F may include a storage compartment SC, a discharge tank 20, a machine compartment MC, a, and an inputter IP. The storage compartment SC, the machine compartment MC, the controller, and the inputter IP of the shoe care apparatus F may components corresponding to the storage compartment, the machine compartment, the controller, and the inputter of the dehumidification apparatus described with reference to FIG. 1, respectively.

The storage compartment SC may include a first housing H1, a door D, a shoe support 90, a fixer 80, a partition plate 40, a lower support plate 60, and a discharge tank 20.

The first housing H1 may be a component corresponding to the first housing described with reference to FIG. 1. The first housing H1 may provide an accommodation space SH. Shoes may be disposed in the accommodation space SH. The shoe support 90, the fixer 80, the partition plate 40, and the lower support plate 60 may be located in the accommodation space SH.

The door D may be a component corresponding to the door described with reference to FIG. 1. The door D may be coupled to a side of the first housing H1. The door D may allow the accommodation space SH to be divided from or connected to the outdoor space. The user may open and close the door D to accommodate shoes in the accommodation space SH or take out shoes from the accommodation space SH.

The shoe support 90 may be located in the accommodation space SH. The shoe may be held on the shoe support 90. A pair of shoes may be held inside a single shoe support 90. The shoe support 90 may be fastened to the fixer 80 and fixed to one side of the first housing H1. The shoe support 90 may be detachably coupled to the first housing H1. For example, the shoe support 90 may be inserted into the fixer 80 in a sliding manner. More specifically, the shoe support 90 may be slid in a horizontal direction from the door D toward the inside of the first housing H1 and coupled to the fixer 80. The shoe support 90 may be provided in plural. For example, two shoe supports 90 may be provided. However, for the sake of simplification of description below, the shoe support 90 will be described in a single unit. Further details of the shoe support 90 will be described below with reference to FIGS. 5 and 6.

The fixer 80 may fix the shoe support 90 at a predetermined position. The fixer 80 may be located on an inner surface of the first housing H1. The fixer 80 may be provided in plural. For example, the fixer 80 may be provided in two fixers 80. The two fixers 80 may be spaced apart in an upper and lower direction. However, for the sake of simplification of description below, the fixer 80 will be described in a single unit. Details of the fixer 80 will be described below with reference to FIGS. 4 and 5.

The partition plate 40 may be located in the accommodation space SH. More specifically, the partition plate 40 may be disposed perpendicular to the inner surface of the first housing H1. The partition plate 40 may have a flat shape that is deployed in a horizontal direction. The partition plate 40 may allow a plurality of pairs of shoes to be stored separately in a single shoe care apparatus F. The partition plates 40 may be provided in plural. For example, the partition plate 40 may be provided as two partition plates 40. However, for the sake of simplification in description below, the partition plate 40 will be described in a single unit.

The lower support plate 60 may be located in a lower portion of the accommodation space SH. The lower support plate 60 may cover the first filter F1 and the second filter F2. The lower support plate 60 may include a lower discharge hole 61. The lower discharge hole 61 may pass through the lower support plate 60 in the upper and lower direction. Through the lower discharge hole 61, air in the accommodation space SH may move to a first filter F1 and a second filter F2. That is, the accommodation space SH may be connected to an inlet 10X through the lower discharge hole 61, the first filter F1, and the second filter F2. The inlet 10X of FIG. 3 may be a component corresponding to the inlet described with reference to FIG. 1. That is, the inlet 10X may be an inlet connected to the circulation path (10*h* in FIG. 1). In addition, the first filter F1 and the second filter F2 may be components corresponding to the first filter and the second filter described with reference to FIG. 1, respectively. Because the inlet 10X is located in the lower portion of the accommodation space SH, air of high humidity in the accommodation space SH may easily flow into the inlet 10X.

The discharge tank 20 may be located below the storage compartment SC. For example, the discharge tank 20 may be inserted into a discharge tank groove 20X. For easy access by a user, the discharge tank 20 may be exposed on the front of the shoe care apparatus F. The discharge tank 20 may provide a discharge inlet 20*h*. Through the discharge inlet 20*h*, water may be introduced into the discharge tank 20. More specifically, water condensed in the first heat exchanger (31 in FIG. 1) described with reference to FIG. 1 may be stored in the discharge tank 20 through the discharge inlet 20*h*. To this end, the positions of the discharge tank 20 and the first heat exchanger 31 may be selected such that the discharge inlet 20*h* is located below the first heat exchanger 31. The user may dispose of the water in the discharge tank 20 by separating the discharge tank 20 from the discharge tank groove 20X whenever a predetermined time passes.

The machine compartment MC may be located below the storage compartment SC. The machine compartment MC may include a second housing H2. The second housing H2 may be a component corresponding to the second housing described with reference to FIG. 1, but unlike FIG. 1, the second housing H2 may be inserted into a lower space of the first housing H1. The internal configuration of the second housing H2 will be described below with reference to FIGS. 7 to 9B.

A steam tank 71, unlike that shown in FIG. 1, may be exposed to the outside of the machine compartment MC. More specifically, the steam tank 71 may be exposed on the front of the shoe care apparatus F so that the user may easily access the steam tank 71. The steam tank 71 may provide a tank inlet 71*h*. Water may be filled in the steam tank 71 through the tank inlet 71*h*. When water is contained in the steam tank 71, steam may be generated by the steam generator 73 and injected into the accommodation space SH as described with reference to FIG. 1. The user may replenish water in the steam tank 71 by separating the steam tank 71 from a tank groove 71X whenever a steam sterilization mode is performed more than a predetermined number of times.

The inputter IP may be coupled to the door D. More specifically, the inputter IP may be located on an upper side of the door D. The inputter IP may be a touchable display. The user may control the shoe care apparatus F using the inputter IP located on the upper side of the door D.

Figure 4:
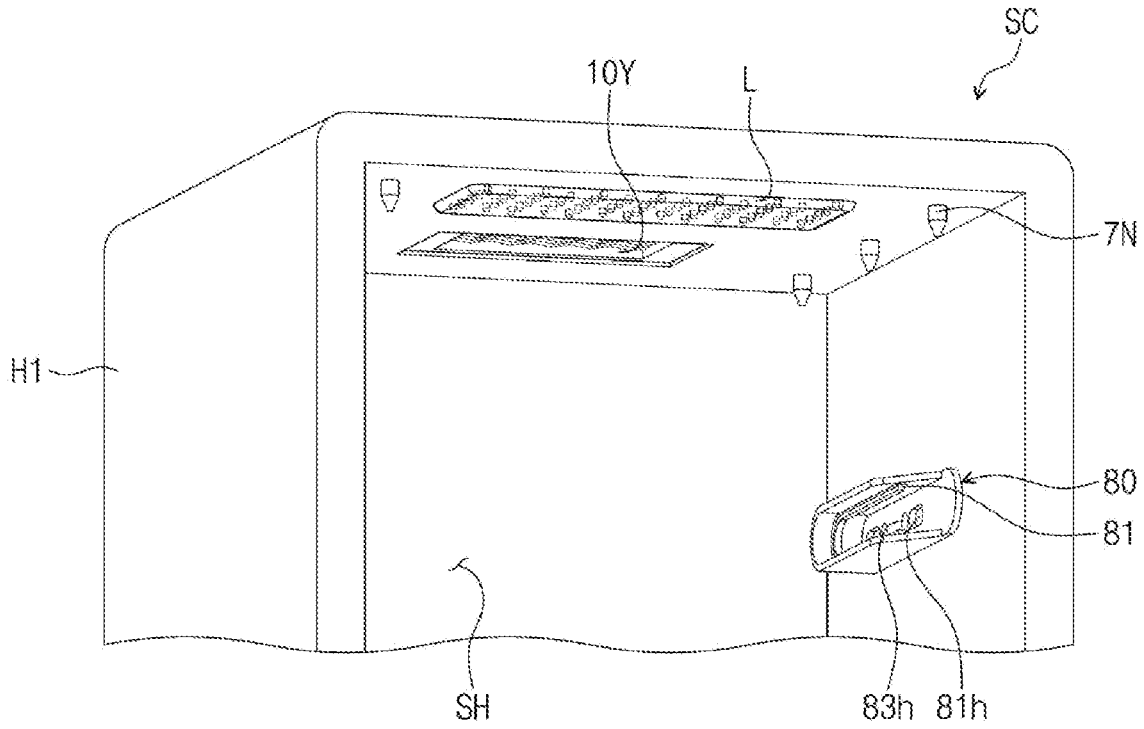
FIG. 4 is an enlarged perspective view illustrating an upper side of a dehumidification apparatus according to embodiments of the disclosure.

FIG. 4 is an enlarged perspective view illustrating an upper side of a dehumidification apparatus according to embodiments of the disclosure.

Referring to FIG. 4, a sterilizing light source L, an outlet 10Y, and a steam injector 7N may be located on the ceiling of the first housing H1. The sterilization light source L, the outlet 10Y, and the steam injector 7N of FIG. 4 may be components corresponding to the sterilization light source, the outlet, and the steam injector described with reference to FIG. 1, respectively. The shoes in the accommodation space SH may be sterilized by ultraviolet rays or the like transmitted from the sterilization light source L.

The outlet 10Y may be connected to an air current circulator of the machine compartment (MC in FIG. 3). The air dehumidified through the air current circulator may return to the accommodation space SH through the outlet 10Y. Because the outlet 10Y is installed on the ceiling of the first housing H1, the low-humidity air from the machine compartment may be spread in the accommodation space SH in a downward direction.

Steam supplied from the steamer of the machine compartment (MC in FIG. 3) may be injected into the accommodation space SH through the steam injector 7N. Because the steam injector 7N is installed on the ceiling of the first housing H1, steam from the machine compartment may be injected onto the shoes in the accommodation space SH in the downward direction.

The fixer 80 may include a sliding bar 81, an air current connection hole 81*h*, and a steam connection hole 83*h*. The sliding bar 81 may extend in a horizontal direction. More specifically, the sliding bar 81 may extend a predetermined length in a horizontal direction from the door (D in FIG. 3) toward the inside of the first housing (H1 in FIG. 3). The air current connection hole 81*h* may be connected to the air current circulator of the machine compartment (MC in FIG. 3). The air current connection hole 81*h* may be a component corresponding to the outlet 10Y described with reference to FIG. 1. The steam connection hole 83*h* may be connected to the steam generator of the machine compartment MC. Details thereof will be described below with reference to FIGS. 5 and 6.

Figure 5:
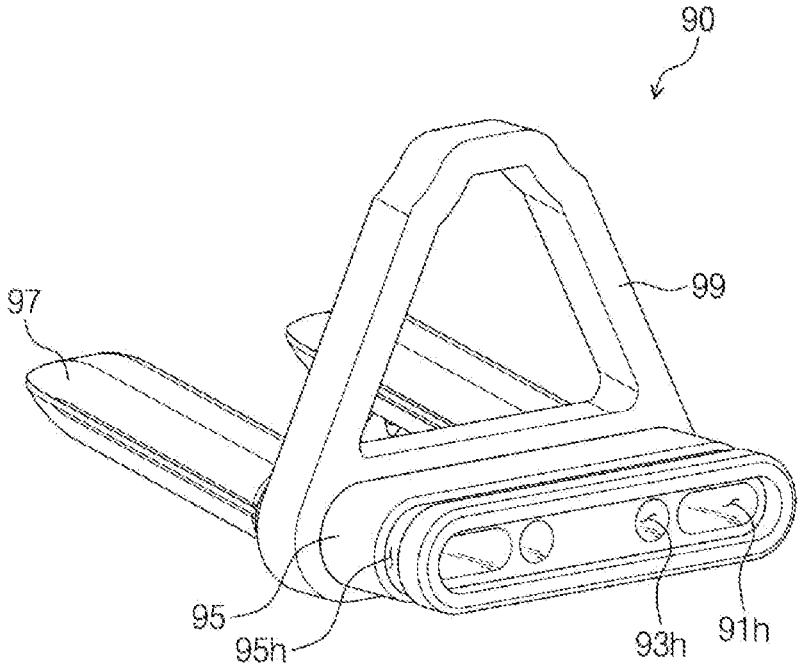
FIG. 5 is an enlarged perspective view illustrating a part of a dehumidification apparatus according to embodiments of the disclosure.
Figure 6:
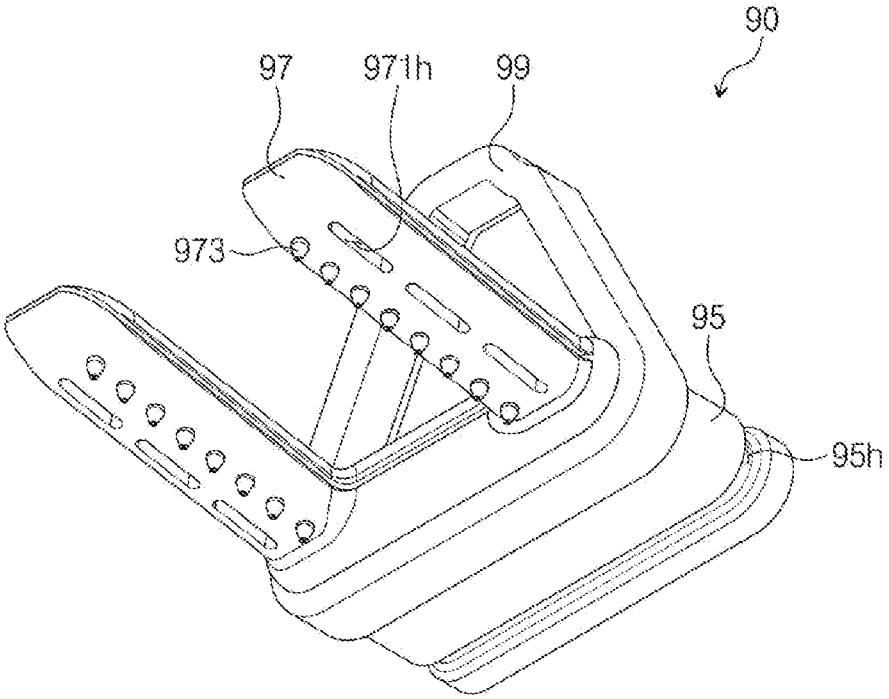
FIG. 6 is an enlarged perspective views illustrating a part of a dehumidification apparatus according to embodiments of the disclosure.

FIGS. 5 and 6 are enlarged perspective views illustrating a part of a dehumidification apparatus according to embodiments of the disclosure.

Referring to FIGS. 5 and 6, the shoe support 90 may include a support body 95, an air current extension hole 91*h*, a steam extension hole 93*h*, a hanger 97, and a handle 99.

The support body 95 may have a shape extending in one direction. The support body 95 may provide a sliding groove 95*h*. The sliding groove 95*h* may extend along the support body 95. The support body 95 may be coupled to the fixer 80 described with reference to FIG. 4. More specifically, the support body 95 may be slidably inserted into the fixer 80 in such a way that the sliding groove 95*h* engages with the sliding bar 81 described with reference to FIG. 4. That is, the support body 95 may slide in a horizontal direction from the door D toward the inside of the first housing H1 and may be slidably coupled to the fixer 80.

The air current extension hole 91*h* may extend from the support body 95 to the inside of the hanger 97. For example, the air current extension hole 91*h* may extend from a rear surface of the support body 95 adjacent to the sliding groove 95*h* toward the hanger 97 in another horizontal direction crossing the one direction. In a state in which the shoe support 90 is coupled to the fixer 80, the air current extension hole 91*h* may communicate with the air current connection hole 81*h* described with reference to FIG. 4.

The steam extension hole 93*h* may extend from the support body 95 to the inside of the hanger 97. For example, the steam extension hole 93*h* may extend from the rear surface of the support body 95 adjacent to the sliding groove 95*h* toward the hanger 97 in another horizontal direction crossing the one direction. The steam extension hole 93*h* may be spaced apart from the air current extension hole 91*h*. In a state in which the shoe support 90 is coupled to the fixer 80, the steam extension hole 93*h* may communicate with the steam connection hole 83*h* described with reference to FIG. 4.

The hanger 97 may be coupled to the front of the support body 95. That is, the hanger 97 may be coupled to the front surface of the support body 95 opposite to the rear surface from which the air current extension hole 91*h* is formed to start. The shoe may be held on the hanger 97. For example, the shoe may be held on the hanger 97 so that the hanger 97 is inserted into the shoe. Two hangers 97 may be coupled to a single support body 95. The two hangers 97 may be spaced apart from each other. For the sake of simplification of description, in the following description, the hanger 97 will be described in a single unit. The hanger 97 may include an outlet 971*h* and a steam injector 973.

The outlet 971*h* may be provided on a lower surface of the hanger 97. The outlet 971*h* may be connected to the air current extension hole 91*h*. Therefore, in the state in which the shoe support 90 is coupled to the fixer 80, the internal air current on the circulation path 10*h* of the air current circulator of the machine compartment (MC, in FIG. 3) passes through the air current connection hole (81*h* in FIG. 4) and the air current extension hole 91, and through the outlet 971*h*, returns to the accommodation space SH. In a state in which a shoe is held on the shoe support 90, the inside of the shoe may be dehumidified by the low-humidity air discharged from the air current circulator. The outlet 971*h* may be provided in plural on a single hanger 97.

The steam injector 973 may be a component corresponding to the steam injector 7N described with reference to FIG. 1. That is, as described with reference to FIG. 4, the shoe care apparatus F does not only include the steam injector 7N on the ceiling of the first housing H1, but also includes the steam injector 973 on the hanger 97. The steam injector 973 may be provided on the lower surface of the hanger 97. The steam injector 973 may be connected to the steam extension hole 93*h*. Therefore, in a state in which the shoe support 90 is coupled to the fixer 80, a steam generated from the steamer of the machine compartment (MC in FIG. 1) may pass through the steam connection hole (83*h* in FIG. 4) and the steam extension hole 93*h*, and through the steam injector 973, jet to the accommodation space SH. In a state in which the shoe is held on the shoe support 90, the inside of the shoe may be sterilized by the steam from the steamer. The steam injector 973 may be provided in plural on a single hanger 97.

The handle 99 may be coupled on the support body 95. The user may move the shoe support 90 by holding the handle 99. For example, in a state in which the shoe is held on the shoe support 90, the user may insert or remove the shoe support 90 into or from the fixer 80 by holding the handle 99.

With the shoe care apparatus according to the embodiments of the disclosure, the shoe may be securely hung inside the first housing H1. In addition, steam sterilization may be performed on the inside and outside of the shoe hung on the shoe support 90. In addition, dehumidification may be performed on the inside and outside of the shoe. Therefore, not only the outside of the shoe but also the inside of the shoe clean may be cared for cleanness.

Figure 7:
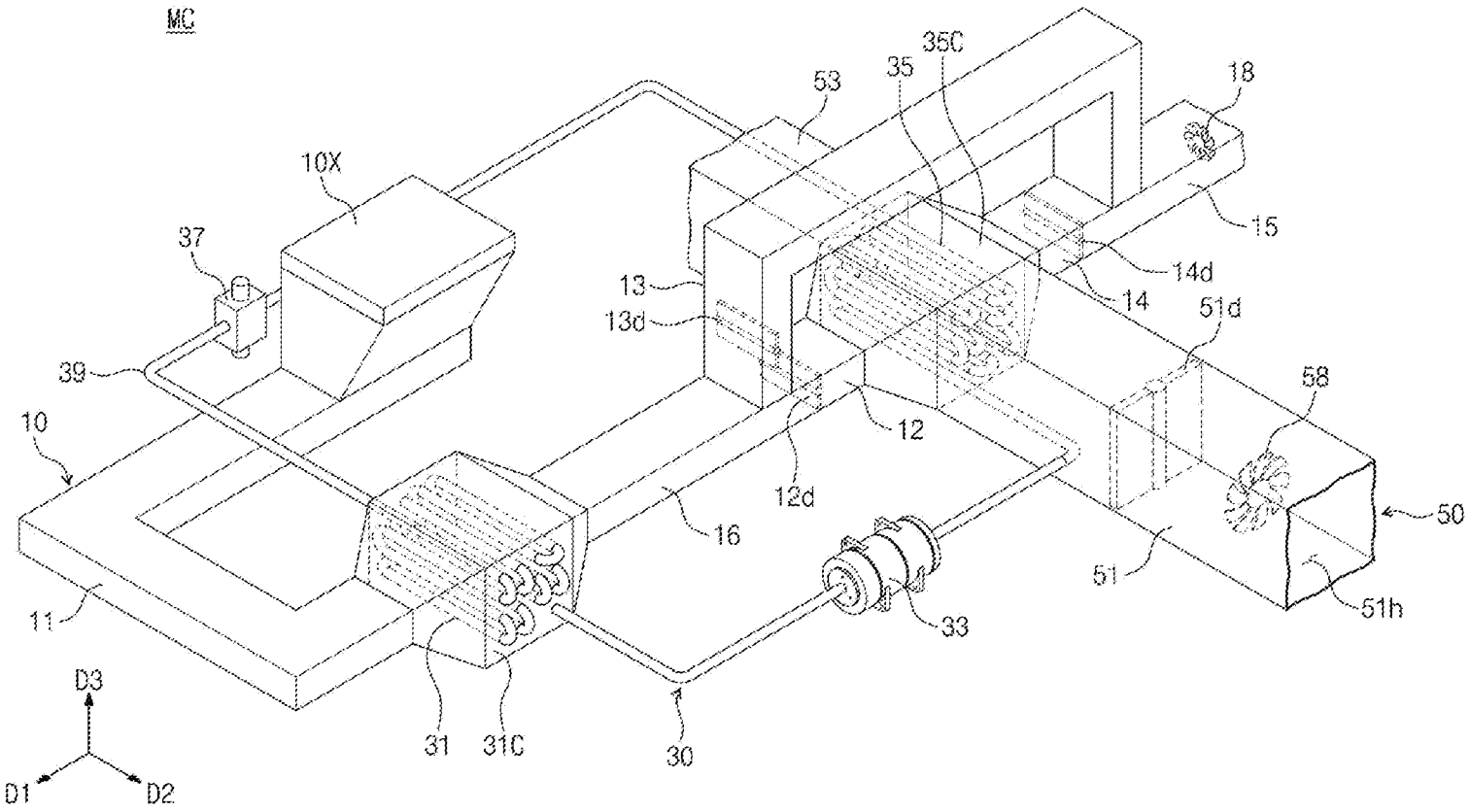
FIG. 7 is a perspective view illustrating a part of a machine compartment of a dehumidification apparatus according to embodiments of the disclosure.

FIG. 7 is a perspective view illustrating a part of a machine compartment of a dehumidification apparatus according to embodiments of the disclosure.

In the following description, a direction D1 in FIG. 7 may be referred to as a first direction, a direction D2 crossing the first direction D1 may be referred to as a second direction, and a direction D3 crossing each of the first direction D1 and the second direction D2 may be referred to as a third direction.

Referring to FIG. 7, the machine compartment MC may include an air current circulator 10, a heat pump 30, a steamer, and an outdoor air cooler 50. The air current circulator 10, the heat pump 30, the steamer, and the outdoor air cooler 50 are components corresponding to the air current circulator, the heat pump, the steamer, and the outdoor air cooler described with reference to FIG. 1, respectively.

The air current circulator 10 may include a first heat exchange duct 11, a first connection duct 16, a second heat exchange duct 12, a bypass duct 13, a second connection duct 14, and an outlet duct 15.

The first heat exchange duct 11 may provide a first heat exchange path (11*h* in FIG. 1). That is, the first heat exchange path 11*h* may be defined by the first heat exchange duct 11. By the first heat exchange duct 11, the inlet 10X may be connected to the first heat exchanger 31.

The first connection duct 16 may provide a first connection path (16*h* in FIG. 1). That is, the first connection path 16*h* may be defined by the first connection duct 16. By the first connection duct 16, the first heat exchanger 31 may be connected to the bypass duct 13 and the second heat exchange duct 12.

The second heat exchange duct 12 may provide a second heat exchange path (12*h* in FIG. 1). That is, the second heat exchange path 12*h* may be defined by the second heat exchange duct 12. By the second heat exchange duct 12, the first connection duct 16 may be connected to the second heat exchanger 35. A first damper 12*d* may be located in the second heat exchange duct 12.

The bypass duct 13 may provide a bypass path (13*h* in FIG. 1). That is, the bypass path 13*h* may be defined by the bypass duct 13. By the bypass duct 13, the first connection duct 16 may be connected to the outlet duct 15. A second damper 13*d* may be located in the bypass duct 13.

The second connection duct 14 may provide a second connection path (14*h* in FIG. 1). That is, the second connection path 14*h* may be defined by the second connection duct 14. By the second connection duct 14, the second heat exchanger 35 may be connected to the outlet duct 15. A fourth damper 14*d* may be located in the second connection duct 14.

The outlet duct 15 may provide an outlet path (15*h* in FIG. 1). That is, the outlet path 15*h* may be defined by the outlet duct 15. By the outlet duct 15, the bypass duct 13 and the second connection duct 14 may be connected to the outlet (10Y in FIG. 1).

The heat pump 30 may include a first heat exchanger 31, a compressor 33, a second heat exchanger 35, an expansion valve 37, and a refrigerant pipe 39. The components of the heat pump 30 may correspond to the respective components of the heat pump described with reference to FIG. 1.

The first heat exchanger 31 may be surrounded by a first heat exchange cover 31C. The first heat exchanger 31 may take a form of a tube in which a passage through which a refrigerant flows is provided. More specifically, the first heat exchanger 31 may have a serpentine tubular shape for efficient heat transfer within the first heat exchange cover 31C. A refrigerant that has moved along the refrigerant pipe 39 may be introduced into the first heat exchanger 31. In certain embodiments, the first heat exchanger 31 may further include a heat absorbing plate for efficiently transferring ambient heat to the refrigerant. The first heat exchange cover 31C may surround at least a portion of the first heat exchanger 31. An inner space defined by the first heat exchange cover 31C may be provided at an inner side of the first heat exchange cover 31C. An internal air current moved along the first heat exchange duct 11 may be introduced into the inner space of the first heat exchange cover 31C. The internal air current may pass through the inner space of the first heat exchange cover 31C and move to the first connection duct 16. When the internal air current passes through the inner space of the first heat exchange cover 31C while exchanging heat with the first heat exchanger 31, the internal air current may be referred to as passing through the first heat exchanger 31. The inner space of the first heat exchange cover 31C may connect a first heat exchange path (11*h* in FIG. 1) provided by the first heat exchange duct 11 to the first connection path (16*h* in FIG. 1) provided by the first connection duct 16. The inner space between the first heat exchange path 11*h* and the first connection path 16*h* may be considered as a part of the circulation path 10*h*. Accordingly, it can be seen that the circulation path 10*h* passes through the first heat exchanger 31 in the first direction D1. When a refrigerant enters the first heat exchanger 31 through the refrigerant pipe 39, the refrigerant may absorb heat from the first heat exchanger 31. Accordingly, the temperature of the first heat exchanger 31 may be lowered. Accordingly, the first heat exchanger 31 may absorb heat from the surroundings. That is, the first heat exchanger 31 may absorb heat from the internal air current on the circulation path 10*h*. More specifically, the first heat exchanger 31 may absorb heat from the internal air current on the circulation path 10*h* that passes through the surroundings of the first heat exchanger 31 in the internal space provided by the first heat exchange cover 31C. The refrigerant passing through the first heat exchanger 31 and absorbing heat may move to the compressor 33 along the refrigerant pipe 39. The internal air current passing through the first heat exchanger 31 and releasing heat may be introduced into the first connection duct 16.

The second heat exchanger 35 may be surrounded by a second heat exchange cover 35C. The second heat exchanger 35 may take a tube in which a passage through which a refrigerant flows is provided. More specifically, the second heat exchanger 35 may have a serpentine tubular shape for efficient heat transfer within the second heat exchange cover 35C. The refrigerant that has moved along the refrigerant pipe 39 may be introduced into the second heat exchanger 35. In certain embodiments, the second heat exchanger 35 may further include a heat dissipating plate for efficiently transferring heat of the refrigerant to the surroundings. The second heat exchange cover 35C may surround at least a portion of the second heat exchanger 35. An inner space (35Ch in FIG. 8A) defined by the second heat exchange cover 35C may be provided at an inner side of the second heat exchange cover 35C. An internal air current that has moved along the second heat exchange duct 12 may be introduced into the inner space 35Ch of the second heat exchange cover 35C. The internal air current may pass through the inner space 35Ch of the second heat exchange cover 35C and move to the second connection duct 14. When the internal air current passes through the inner space 35Ch of the second heat exchange cover 35C while exchanging heat with the second heat exchanger 35, the internal air current may be referred to as passing through the second heat exchanger 35. The inner space 35Ch of the second heat exchange cover 35C may connect a second heat exchange path (12*h* in FIG. 1) provided by the second heat exchange duct 12 to a second connection path (14*h* in FIG. 1) provided by the second connection duct 14. The inner space 35Ch between the second heat exchange path 12*h* and the second connection path 14*h* may be considered a part of the circulation path 10*h*. Accordingly, the circulation path 10*h* passes through the second heat exchanger 35 in the first direction D1. When a refrigerant enters the second heat exchanger 35 through the refrigerant pipe 39, the refrigerant may release heat to the second heat exchanger 35. Accordingly, the temperature of the second heat exchanger 35 may rise. Accordingly, the second heat exchanger 35 may release heat to the surroundings. That is, the second heat exchanger 35 may release heat to the internal air current on the circulation path 10*h*. More specifically, the second heat exchanger 35 may release heat to the internal air current on the circulation path 10*h* that passes through the surrounding of the second heat exchanger 35 in the inner space 35Ch provided by the second heat exchange cover 35C. The refrigerant having released heat while passing through the second heat exchanger 35 may move to the expansion valve 37 along the refrigerant pipe 39. The internal air current having heat while passing through the second heat exchanger 35 may be introduced into the second connection duct 14.

The outdoor air cooler 50 may include an outdoor air inlet duct 51 and an outdoor air outlet duct 53.

The outdoor air inlet duct 51 may provide an outdoor air inlet path 51*h*. That is, the outdoor air inlet path 51*h* may be defined by the outdoor air inlet duct 51. A first outdoor air damper 51*d* and an outdoor air cooling blower 58 may be located in the outdoor air inlet duct 51. An end of the outdoor air inlet duct 51 may be connected to a space outside the machine compartment MC, further, the outdoor space of the shoe care apparatus (F in FIG. 3). In addition, the other end of the outdoor air inlet duct 51 may be connected to the second heat exchanger 35.

The outdoor air outlet duct 53 may provide an outdoor air outlet path (53*h* in FIG. 1). That is, the outdoor air outlet path 53*h* may be defined by the outdoor air outlet duct 53. An end of the outdoor air outlet duct 53 may be connected to the second heat exchanger 35. The outdoor air outlet duct 53 may be connected to the outdoor air inlet duct 51 through the second heat exchanger 35. In addition, the other end of the outdoor air outlet duct 53 may be connected to a space outside the machine compartment MC, further, the outdoor space of the shoe care apparatus (F in FIG. 3).

Figure 8A:
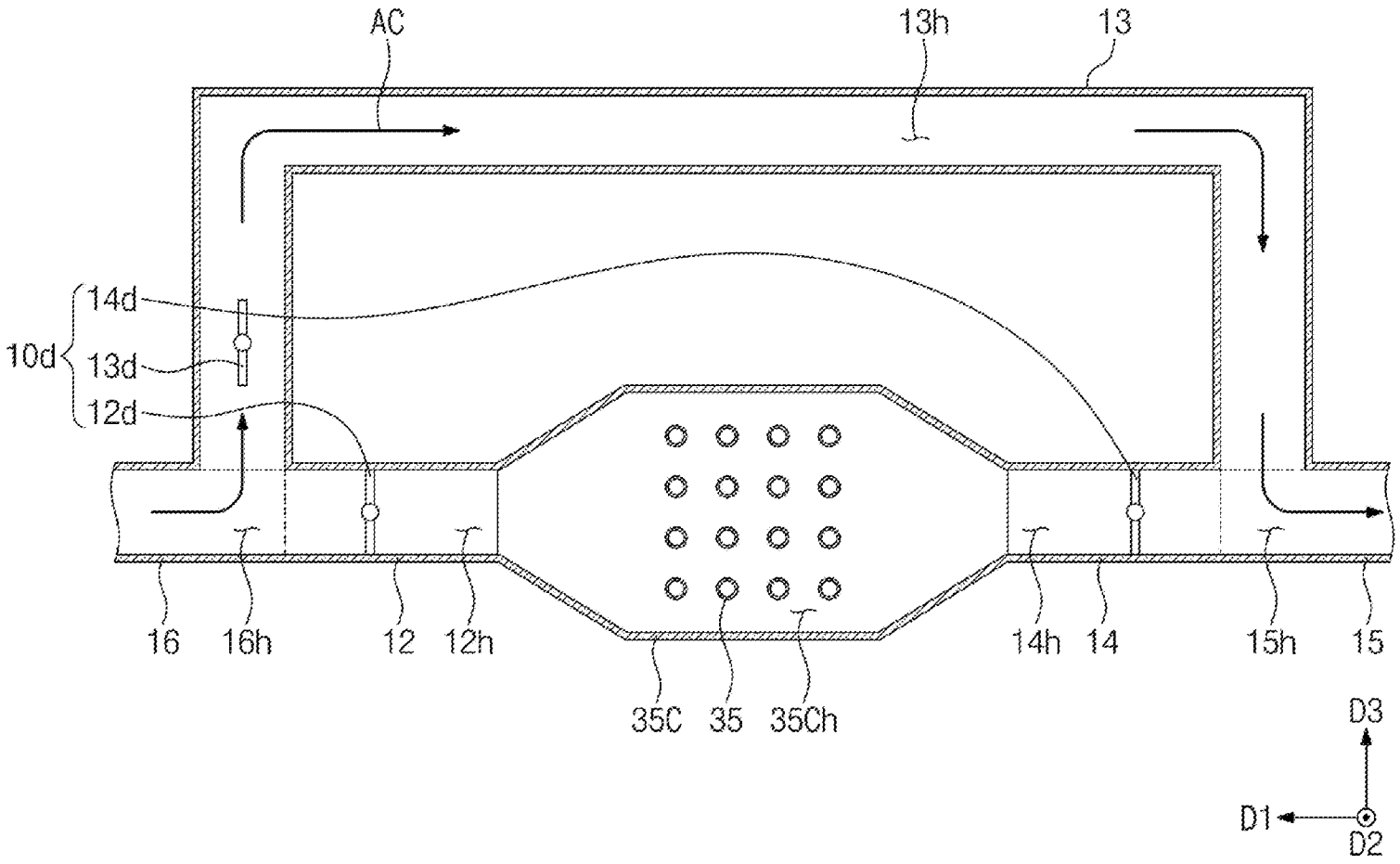
FIG. 8A is a cross-sectional view showing a portion cut away from FIG. 7.
Figure 8B:
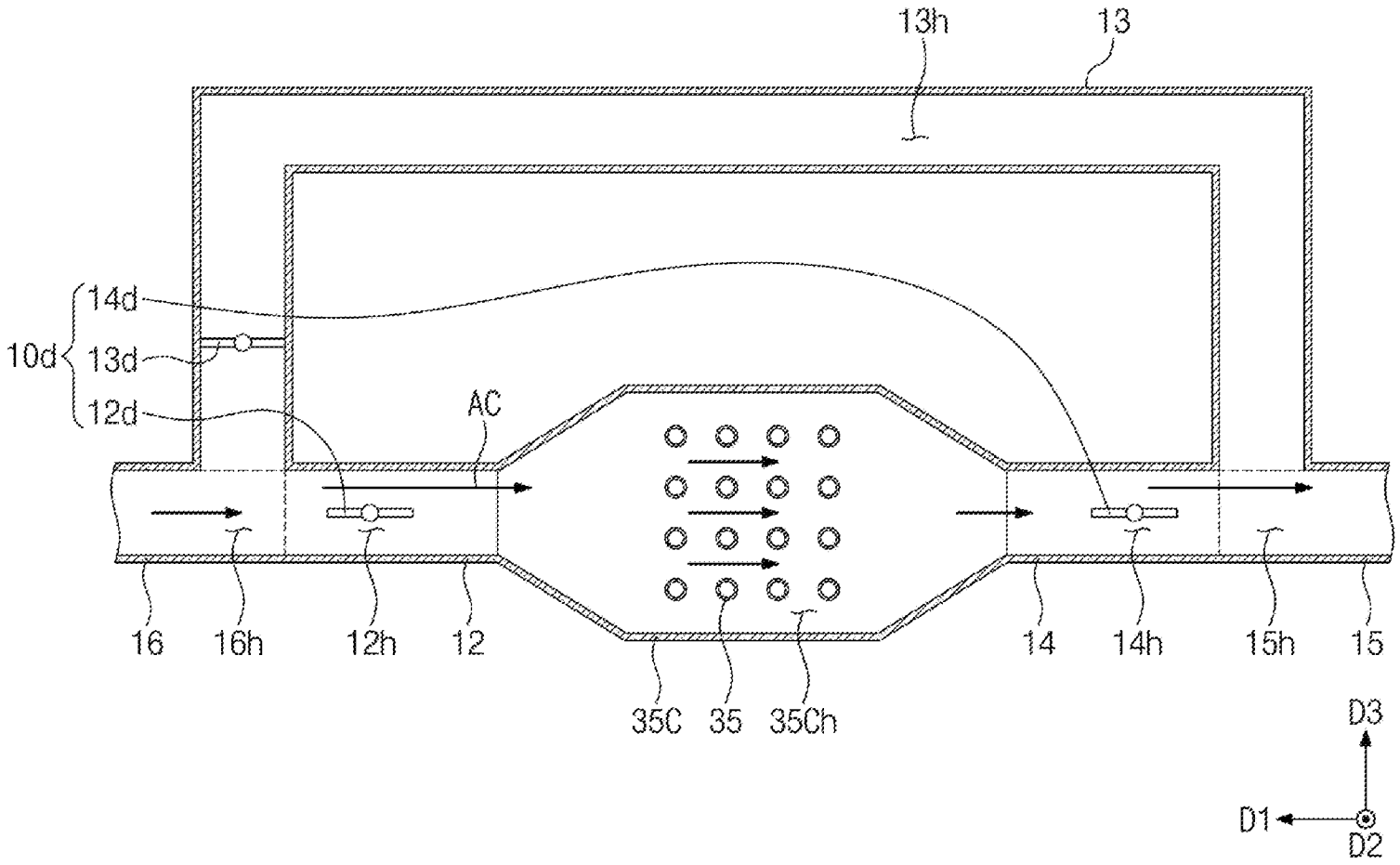
FIG. 8B is a cross-sectional views showing a portion cut away from FIG. 7.
Figure 9A:
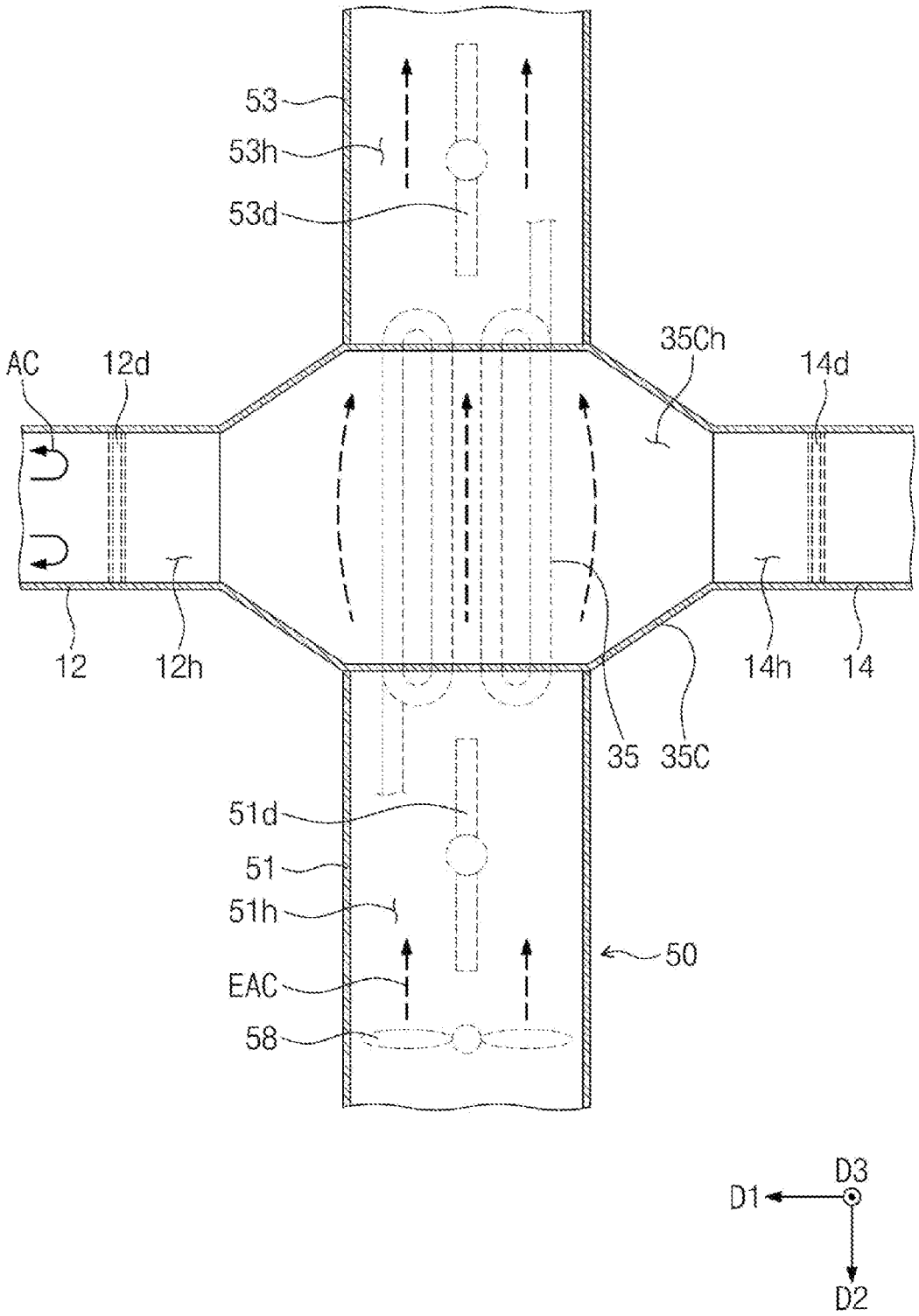
FIG. 9A is a plan view of some areas of FIG. 7.
Figure 9B:
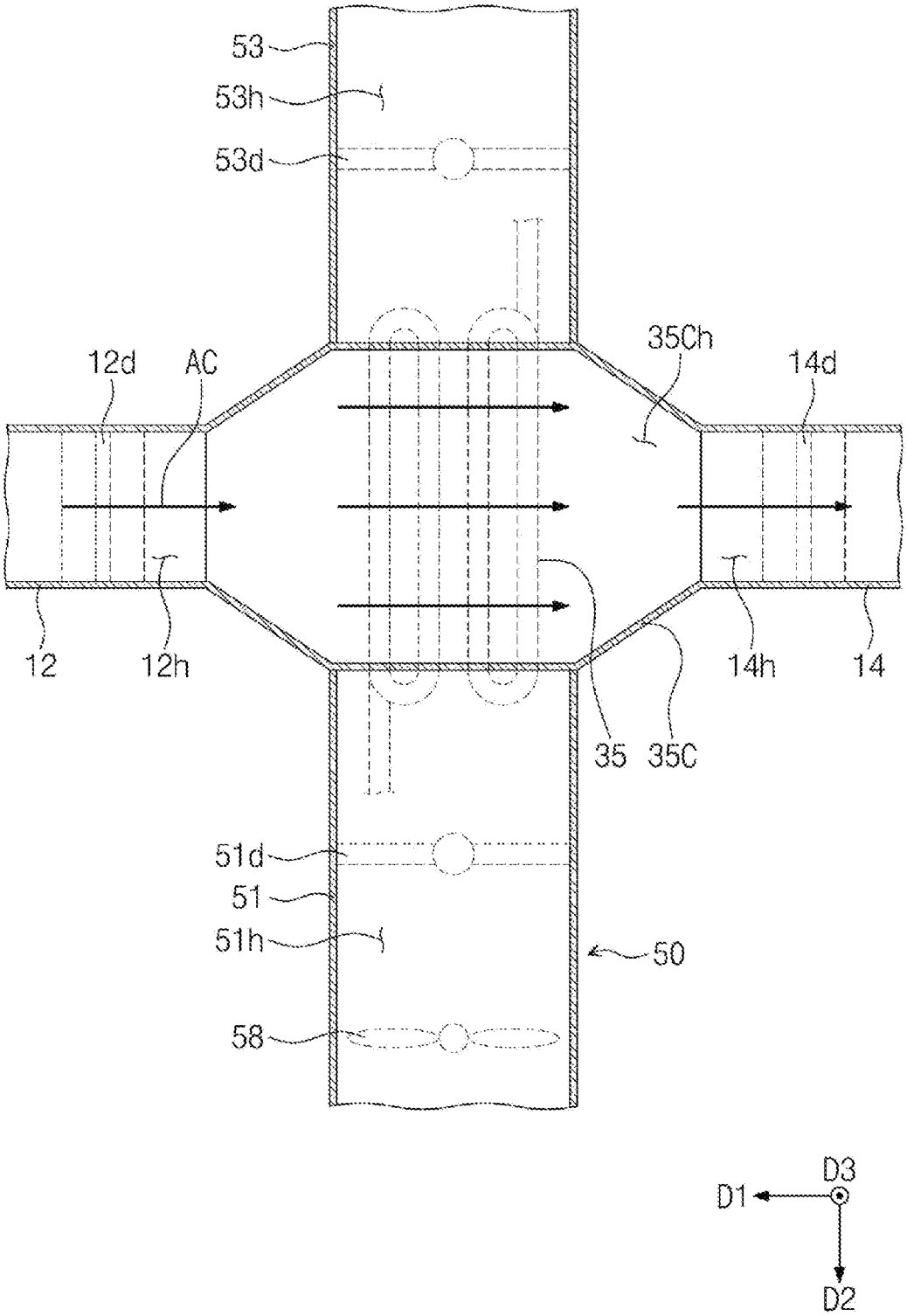
FIG. 9B is a plan view of some areas of FIG. 7.

FIGS. 8A and 8B are cross-sectional views showing a portion cut away from FIG. 7, and FIGS. 9A and 9B are plan views of some areas of FIG. 7.

Referring to FIGS. 8A and 9A, the first dehumidifying mode executed by the controller (C in FIG. 1) will be described.

First, referring to FIG. 8A, the first damper 12*d* and the fourth damper 14*d* may be closed under the control of the controller C. In addition, the second damper 13*d* may be opened under the control of the controller C. Accordingly, the internal air current AC of the first connection path 16*h* may bypass the second heat exchanger 35 along the bypass path 13*h*. The internal air current AC may not exchange heat with the second heat exchanger 35. Accordingly, the temperature of the internal air current AC may remain relatively low in temperature. The low-temperature internal air current AC may return to the accommodation space (SH in FIG. 2) through the outlet path 15*h*. As such, the first dehumidifying mode in which the accommodation space SH is supplied with low-temperature and low-humidity air may be performed.

Next, referring to FIG. 9A, in the first dehumidifying mode, the first outdoor air damper 51*d* and the second outdoor air damper 53*d* may be opened under the control of the controller C. In addition, the outdoor air cooling blower 58 may be driven. The refrigerant in the second heat exchanger 35 may be cooled only by the external air current EAC rather than by the internal air current AC on the circulation path 10*h*. In this case, the first damper (12*d* in FIG. 8B) and the fourth damper (14*d* in FIG. 8B) are closed, and thus the external air current EAC may not flow into the accommodation space SH. In addition, the internal air current AC circulating along the circulation path 10*h* may not flow out to the outside. Accordingly, odors in the internal air current may be prevented from leaking to the outside.

Referring to FIGS. 8B and 9B, the second dehumidifying mode executed by the controller (C in FIG. 1) will be described.

First, referring to FIG. 8B, the first damper 12*d* and the fourth damper 14*d* may be opened under the control of the controller C. In addition, the second damper 13*d* may be closed under the control of the controller C. Accordingly, the internal air current AC on the first connection path 16*h* may flow into the inner space 35Ch defined by the second heat exchange cover 35C along the second heat exchange path 12*h*. The internal air current AC may receive heat from the second heat exchanger 35 in the second heat exchange cover 35C. Accordingly, the temperature of the internal air current AC may rise. The internal air current AC in a high temperature state may pass through the second connection path 14*h* and the outlet path 15*h* and return to the accommodation space (SH in FIG. 2). As such, the second dehumidifying mode in which the accommodation space SH is supplied with high-temperature and low-humidity air may be performed.

Next, referring to FIG. 9B, in the second dehumidifying mode, the first outdoor air damper 51*d* and the second outdoor air damper 53*d* may be closed under the control of the controller C. In addition, the outdoor air cooling blower 58 may not be driven. The refrigerant in the second heat exchanger 35 may be cooled only by the internal air current on the circulation path 10*h*, rather than by the outdoor air. Accordingly, outdoor air may not flow into the second heat exchanger 35. In addition, the internal air current AC circulating along the circulation path 10*h* may not flow out to the outside. Accordingly, odors in the internal air current may be prevented from leaking to the outside.

Figure 10:
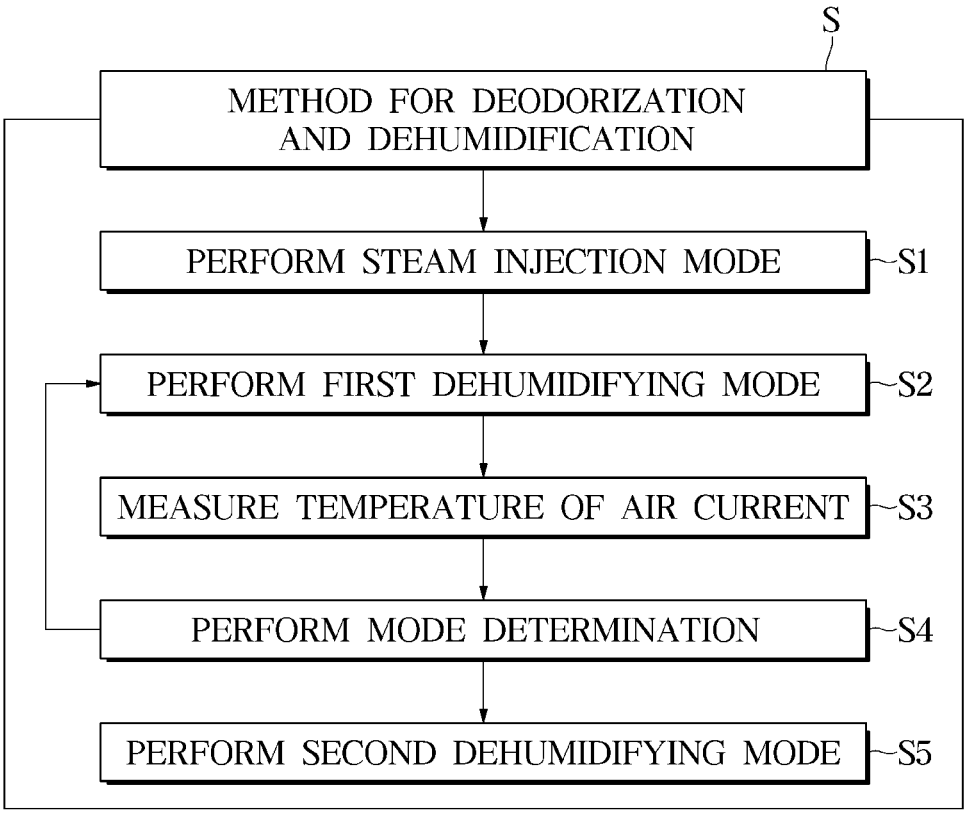
FIG. 10 is a flowchart showing a dehumidification method using a dehumidification apparatus according to embodiments of the disclosure.

FIG. 10 is a flowchart showing a dehumidification method using a dehumidification apparatus according to embodiments of the disclosure.

Referring to FIG. 10, a dehumidification method S may be provided. The dehumidification method S may be a method of performing care and storage on shoes using a dehumidification apparatus. The dehumidification method S may include performing a steam injection mode S1, performing a first dehumidifying mode S2, measuring the temperature of the air current S3, performing mode determination S4, and performing a second dehumidifying mode S5. Hereinafter, each operation of the dehumidification method S shown in FIG. 10 will be described with reference to FIGS. 1 to 9B.

Referring to FIGS. 1 and 10, the performing of the steam injection mode (S1) may include injecting steam into the accommodation space SH using the steamer 70. More specifically, in response to shoes in the accommodation space SH requiring steam sterilization, the controller C may inject steam into the accommodation space SH using the steamer 70, to perform steam sterilization on the shoes. Under the control of the controller C, water in the steam tank 71 moves along the steam pipe 77 and becomes steam in the steam generator 73, and the steam is injected to the accommodation space SH through the steam injector 7N. As described with reference to FIGS. 4 to 6, when the steam injectors 7N are disposed in various places, steam sterilization may be performed on the inside and outside of the shoe through steam injection. By the steam injected into the accommodation space SH, the temperature of the accommodation space SH may be significantly high.

Referring to FIGS. 7, 8A, 9A and 10, the performing of the first dehumidifying mode (S2) may including allowing air inside the accommodation space (SH in FIG. 1) to move along the circulation path 10*h* of the air current circulator 10 and exchange heat with the first heat exchanger 31. The air in the accommodation space SH may move along the first heat exchange path 11*h* and release heat in the first heat exchanger 31. That is, the first heat exchanger 31 may absorb heat of the internal air current. Accordingly, the temperature of the internal air current passed through the first heat exchanger 31 may be lowered.

The performing of the first dehumidifying mode (S2) may include allowing the internal air current that has passed through the first heat exchanger 31 to return to the accommodation space SH by bypassing the second heat exchanger 35. To this end, the controller C may close the first damper 12*d* and the fourth damper 14*d* and open the second damper 13*d*. The internal air current that has passed through the first heat exchanger 31 and has become in a low temperature state may bypass the second heat exchanger 35 along the bypass path 13*h*. That is, the internal air current may not exchange heat with the second heat exchanger 35. Accordingly, the low-temperature internal air current may return to the accommodation space SH while remaining relatively low in temperature. Accordingly, the air in the accommodation space SH, which has been heated by the steam, may be cooled rapidly. That is, the temperature of the accommodation space SH may be rapidly lowered. Accordingly, the shoes in the accommodation space SH injected with the steam may be prevented from being damaged by the high temperature. In addition, because the temperature of the accommodation space SH is rapidly lowered, the stroke time of the dehumidification apparatus may be shortened.

The performing of the first dehumidifying mode (S2) may include cooling, by the controller C, the second heat exchanger 35 with an external air current using the outdoor air cooler 50. More specifically, the controller C may open the first outdoor air damper 51*d* and the second outdoor air damper 53*d*, and operate the outdoor air cooling blower 58. Accordingly, the air outside the shoe care apparatus F may enter the second heat exchanger 35 along the outdoor air inlet path 51*h*. The second heat exchanger 35 may release heat to the external air current. Accordingly, the refrigerant in the second heat exchanger 35 may be condensed by releasing heat. The external air current that has received heat from the second heat exchanger 35 may exit to the outside along the outdoor air outlet path 53*h*.

Referring again to FIGS. 1 and 10, the measuring of the temperature of the air current (S3) may include measuring the temperature of the internal air current returning to the accommodation space SH using the temperature sensor 19. Alternatively, when the temperature sensor 19 is located in the accommodation space SH and/or outside the accommodation space SH, the temperature sensor 19 may measure the internal and/or external temperature of the accommodation space SH. Information about the temperature measured by the temperature sensor 19 may be transmitted to the controller C.

The performing of the mode determination (S4) may include determining, by the controller C, whether to perform the first dehumidifying mode or perform the second dehumidifying mode based on the information received from the temperature sensor 19. For example, the controller C may compare a target temperature with the temperature currently supplied to the accommodation space SH to determine a mode to be performed. More specifically, in response to the target temperature being lower than the measured current temperature, the controller C may continue to perform the first dehumidifying mode such that the temperature of the internal air current supplied to the accommodation space SH is lowered to the target temperature. Conversely, in response to the target temperature being higher than the measured current temperature, the controller C may stop the first dehumidifying mode to increase the temperature of the internal air current supplied to the accommodation space SH, and may perform the second dehumidifying mode. The target temperature may be a temperature input by a user. Alternatively, the target temperature may be a temperature previously stored in the controller C that is optimized for caring and/or storing shoes.

FIGS. 7, 8B, 9B and 10, the performing of the second dehumidifying mode (S5) may including allowing air inside the accommodation space (SH in FIG. 1) to move along the circulation path 10*h* of the air current circulator 10 and exchange heat with the first heat exchanger 31. The air in the accommodation space SH may move along the first heat exchange path 11*h* and release heat in the first heat exchanger 31. That is, the first heat exchanger 31 may absorb heat of the internal air current. Accordingly, the temperature of the internal air current having passed through the first heat exchanger 31 may be lowered.

The performing of the second dehumidifying mode (S5) may include allowing the internal air current having passed through the first heat exchanger 31 to exchange heat with the second heat exchanger 35 and then return to the accommodation space SH. To this end, the controller C may open the first damper 12*d* and the fourth damper 14*d* and close the second damper 13*d*. The internal air current having passed through the first heat exchanger 31 and converted into a low temperature state may be directed to the second heat exchanger 35 along the second heat exchange path 12*h*. The internal air current on the circulation path 10*h* may absorb heat from the second heat exchanger 35. Accordingly, the internal air current in a low temperature state may be converted into relatively high temperature state. The internal air current converted into a high temperature state due to heat exchange with the second heat exchanger 35 may return to the accommodation space SH along the outlet path 15*h*. Accordingly, the temperature of the air in the accommodation space SH, which has been lowered as a result of the first dehumidifying mode, may be slightly increased or may be maintained at a certain level. That is, the temperature of the accommodation space SH may be managed at an appropriate level. Accordingly, the shoes in the accommodation space SH may be stored at an appropriate temperature.

The performing of the second dehumidifying mode (S5) may include stopping, by the controller C, the outdoor air cooling of the second heat exchanger 35 using the outdoor air cooler 50C. More specifically, the controller C may close the first outdoor air damper 51*d* and the second outdoor air damper 53*d*, and stop the operation of the outdoor air cooling blower 58. Accordingly, air outside the shoe care apparatus F may not flow into the second heat exchanger 35. In addition, the internal air current on the circulation path 10*h* may not flow to the outside.

Although the shoe care apparatus (F in FIG. 2) has been described as an example of the apparatus (100 in FIG. 1) for dehumidification, the disclosure is not limited thereto. That is, the dehumidification apparatus 100 may perform care and storage on tops and bottoms as well as shoes.

Figure 11:
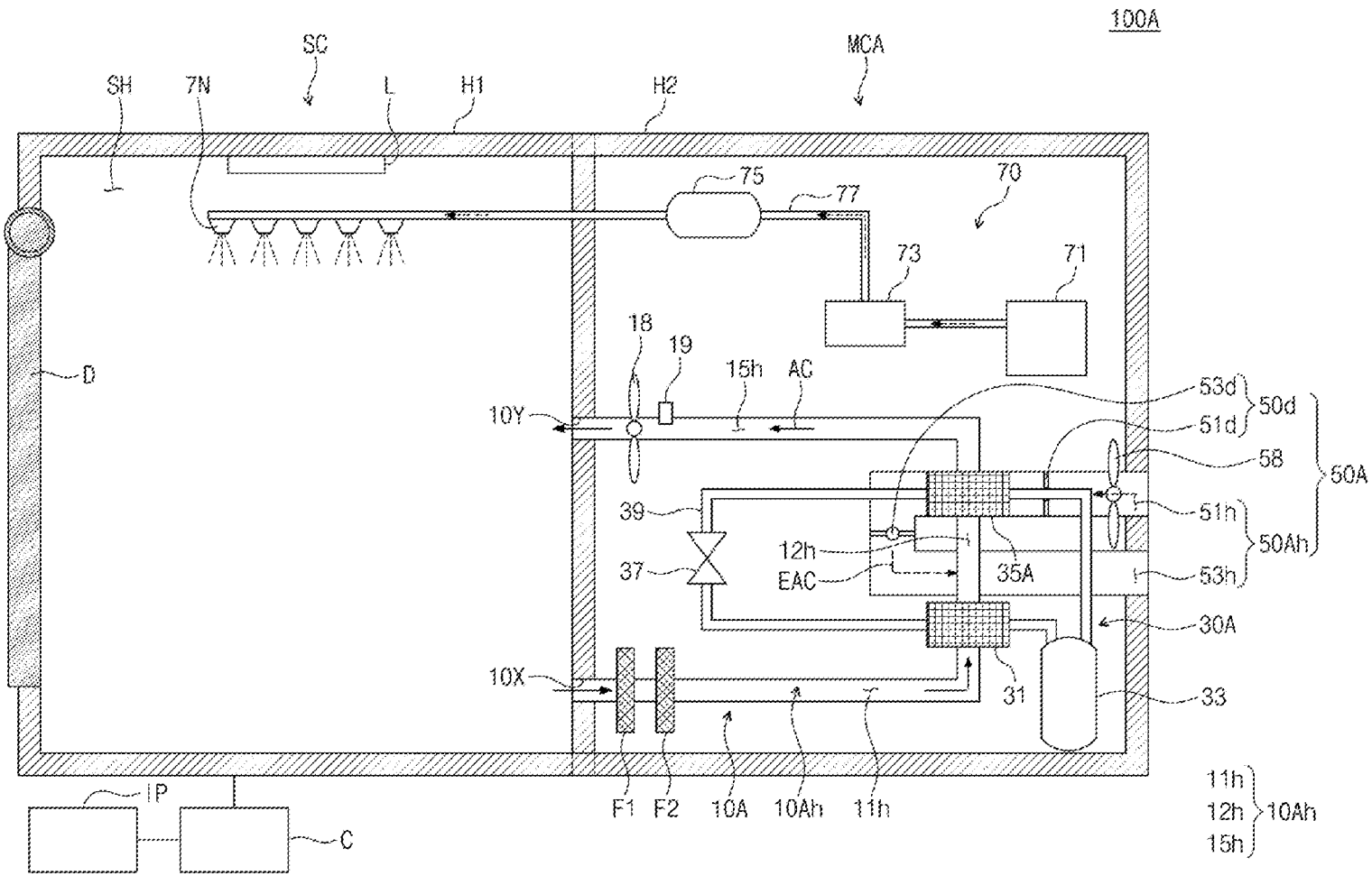
FIG. 11 is a schematic diagram illustrating a dehumidification apparatus according to embodiments of the disclosure.

FIG. 11 is a schematic diagram illustrating a dehumidification apparatus according to embodiments of the disclosure.

In the following description, components that are substantially the same as or similar to those described with reference to FIGS. 1 to 10 may be omitted, or described in brief, for the sake of convenience in description.

Referring to FIG. 11, a dehumidification apparatus 100A may be provided. The dehumidification apparatus 100A may be partially similar to the dehumidification apparatus 100 described with reference to FIG. 1. The dehumidification apparatus 100A may include a storage compartment SC, a machine compartment MCA, a controller C, and an inputter IP. The storage compartment SC, the controller C, and the inputter IP may be substantially the same as or similar to the storage compartment, the controller, and the inputter described with reference to FIG. 1, respectively.

The machine compartment MCA may include a second housing H2, a steamer 70, a heat pump 30A, an air current circulator 10A, and an outdoor air cooler 50A.

The second housing H2 may be substantially the same as or similar to the second housing described with reference to FIG. 1. The steamer 70 may be substantially the same as or similar to the steamer described with reference to FIG. 1.

The heat pump 30A may include a refrigerant pipe 39, a first heat exchanger 31, a compressor 33, a second heat exchanger 35A, and an expansion valve 37. The refrigerant pipe 39, the first heat exchanger 31, the compressor 33, and the expansion valve 37 may be substantially the same as or similar to the refrigerant pipe, the first heat exchanger, the compressor, and the expansion valve described with reference to FIG. 1, respectively. The second heat exchanger 35A may be slightly different from the second heat exchanger 35 described with reference to FIG. 1. Details of the second heat exchanger 35A will be described below with reference to FIGS. 13 and 14.

The air current circulator 10A may provide a circulation path 10Ah. However, the air current circulator 10A may be slightly different from the air current circulator 10 described with reference to FIG. 1. For example, the air current circulator 10A may not provide the bypass path shown in FIG. 1. That is, the circulation path 10Ah may provide only a first heat exchange path 11*h*, a second heat exchange path 12*h*, and an outlet path 15*h*.

The outdoor air cooler 50A may be connected to the second heat exchanger 35A. More specifically, the outdoor air cooler 50A may be connected to the second heat exchanger 35A to cool the second heat exchanger 35A using an external air current. The outdoor air cooler 50A may include an outdoor air cooling path 50Ah, an outdoor air damper 50*d*, and an outdoor air cooling blower 58. The outdoor air cooling path 50Ah, the outdoor air damper 50*d*, and the outdoor air cooling blower 58 may be substantially the same as or similar to those described with reference to FIG. 1. However, a portion at which the outdoor air cooler 50A is connected to the second heat exchanger 35A may be different from that described with reference to FIG. 1.

The following description will be made in relation to a part of the dehumidification apparatus 100A that is different from that of FIG. 1.

The internal air current moving along the circulation path 10Ah may pass through the second heat exchanger 35A. That is, the internal air current may not bypass the second heat exchanger 35A. At the second heat exchanger 35A, the circulation path 10Ah may cross the outdoor air cooling path 50Ah. The internal air current on the circulation path 10Ah may exchange heat with the second heat exchanger 35A. In addition, the external air current on the outdoor air cooling path 50Ah may exchange heat with the second heat exchanger 35A. At the second heat exchanger 35A, the outdoor air cooling path 50Ah may not be connected to the circulation path 10Ah. More specifically, at the second heat exchanger 35A, the outdoor air cooling path 50Ah may be separated from and unconnected with the circulation path 10Ah. Therefore, the internal air current moving along the circulation path 10Ah may be prevented from flowing out of the dehumidification apparatus 100A through the outdoor air cooling path 50Ah at the second heat exchanger 35A. In addition, the external air current on the outdoor air cooling path 50Ah may be prevented from flowing into the accommodation space SH through the circulation path 10Ah at the second heat exchanger 35A. An example of a configuration for not connecting the outdoor air cooling path 50Ah to the circulation path 10Ah at the second heat exchanger 35A will be described below with reference to FIGS. 13 and 14.

The dehumidification apparatus 100A according to the embodiment of FIG. 11 may also perform a steam injection mode, a first dehumidifying mode, and a second dehumidifying mode. The steam injection mode may be substantially the same as or similar to that described with reference to FIG. 1.

In the first dehumidifying mode, the internal air current AC on the circulation path 10Ah may continuously pass through the second heat exchanger 35A. In addition, the controller C may open the first outdoor air damper 51*d* and the second outdoor air damper 53*d*. As needed, the controller C may operate the outdoor air cooling blower 58. Accordingly, the outdoor air cooler 50A may exchange heat with the second heat exchanger 35A. More specifically, the second heat exchanger 35A may release heat to the external air current on the outdoor air cooling path 50Ah. Accordingly, the refrigerant passing through the second heat exchanger 35A may be condensed. Because the outdoor air cooler 50A absorbs heat from the second heat exchanger 35A, the internal air current on the circulation path 10Ah may absorb a relatively small amount of heat or may not absorb heat. Therefore, the internal air current on the circulation path 10Ah, which has passed through the first heat exchanger 31 and converted into a low temperature state, may remain relatively low in temperature. Accordingly, the accommodation space SH may be supplied with relatively low temperature air.

In the second dehumidifying mode, the internal air current AC on the circulation path 10Ah may continuously pass through the second heat exchanger 35A. On the other hand, heat exchange between the outdoor air cooler 50A and the second heat exchanger 35A may be stopped. More specifically, the controller C may close the first outdoor air damper 51*d* and the second outdoor air damper 53*d*. Alternatively, the controller C may stop the operation of the outdoor air cooling blower 58 while the first outdoor air damper 51*d* and the second outdoor air damper 53*d* are open. Accordingly, the second heat exchanger 35A may not exchange heat with the external air current. The second heat exchanger 35A may exchange heat only with the internal air current on the circulation path 10Ah. The internal air current on the circulation path 10Ah passing through the second heat exchanger 35A receives heat, so that the temperature of the internal air current may rise. Accordingly, the accommodation space SH may be supplied with relatively high temperature air.

The dehumidification apparatus 100A according to the embodiments of the disclosure described with reference to FIG. 11 may have substantially the same or similar effects as the dehumidification apparatus 100 described with reference to FIG. 1.

In the above, the configuration of the dehumidification apparatus 100A according to the disclosure has been briefly described with reference to FIG. 11. Hereinafter, an embodiment in which the dehumidification apparatus 100A according to the disclosure is applied to a specific product will be described with reference to FIGS. 12 to 15B.

Figure 12:
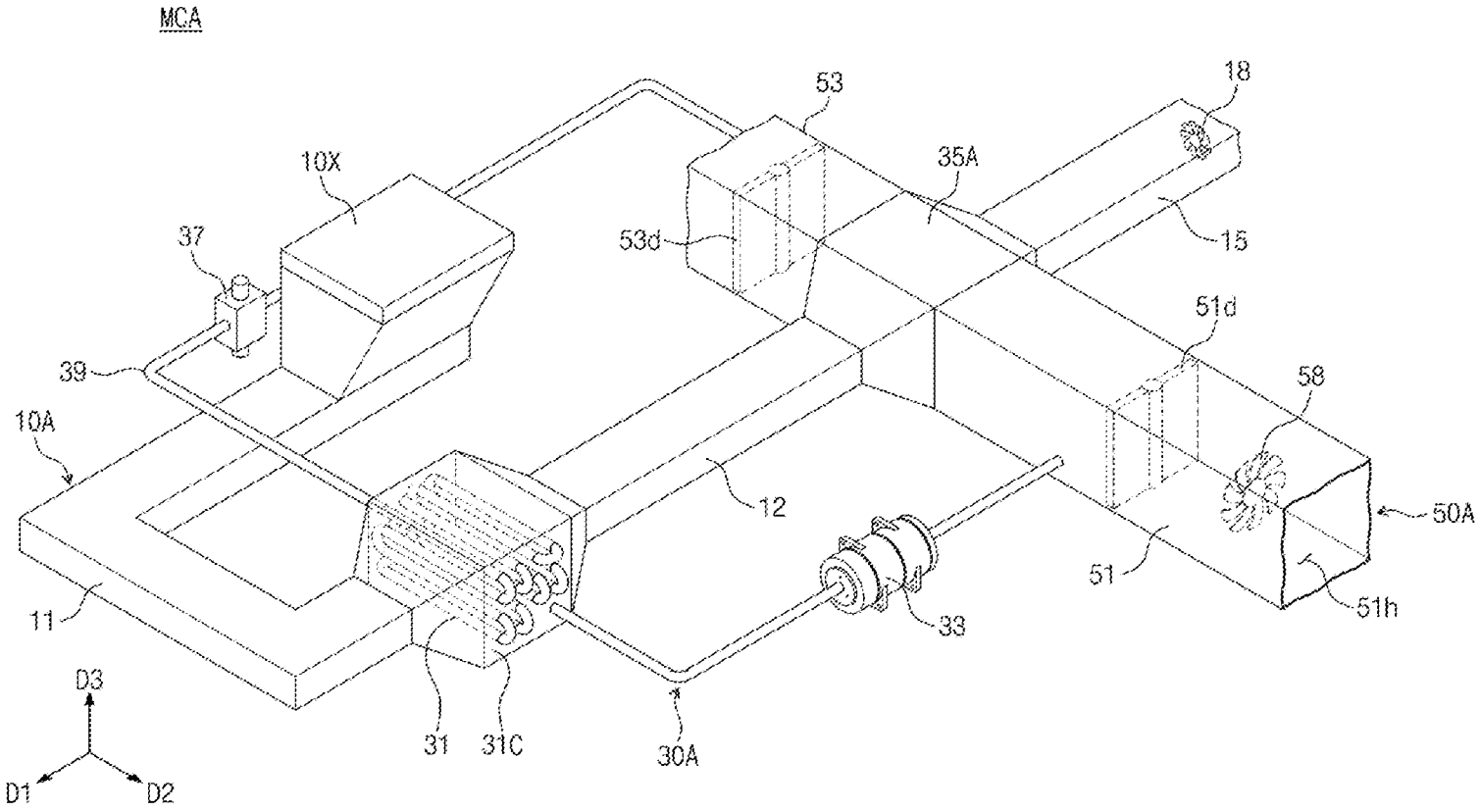
FIG. 12 is a perspective view illustrating a part of a machine compartment of a dehumidification apparatus according to embodiments of the disclosure.

FIG. 12 is a perspective view illustrating a part of a machine compartment of a dehumidification apparatus according to embodiments of the disclosure.

The dehumidification apparatus shown in FIG. 11 may be applied to a shoe care apparatus. An embodiment in which the dehumidification apparatus of FIG. 11 is applied to a shoe care apparatus may include all the components described with reference to FIGS. 2 to 6. Accordingly, for the sake of convenience in description, components corresponding to those described with reference to FIGS. 2 to 6 may be omitted in the following description and only differences from the embodiment of FIG. 7 will be described.

Referring to FIG. 12, the machine compartment MCA of the shoe care apparatus may include a steamer, an air current circulator 10A, a heat pump 30A, and an outdoor air cooler 50A.

At the second heat exchanger 35A, the air current circulator 10A may overlap the outdoor air cooler 50A. Unlike the air current circulator 10 described with reference to FIG. 7, the air current circulator 10A may not include the bypass duct (13 in FIG. 7) and the air current diverter (10*d* in FIG. 1).

The second heat exchanger 35A of the heat pump 30A may be different from the second heat exchanger 35 described with reference to FIG. 7. Details thereof will be described below with reference to FIGS. 13 and 14.

At the second heat exchanger 35A, the outdoor air cooler 50A may overlap the air current circulator 10A and the second heat exchanger 35A. The outdoor air inlet path 51*h* may be defined by the outdoor air inlet duct 51. The outdoor air outlet path (53*h* in FIG. 11) may be defined by the outdoor air outlet duct 53. However, the disclosure is not limited thereto, and the outdoor air inlet path 51*h* and the outdoor air outlet path 53*h* may refer to a movement path of the external air current formed in a portion of the space inside the machine compartment MCA without having a separate duct.

Hereinafter, the second heat exchanger 35A of the shoe care apparatus will be described in detail with reference to FIGS. 13 to 14.

Figure 13:
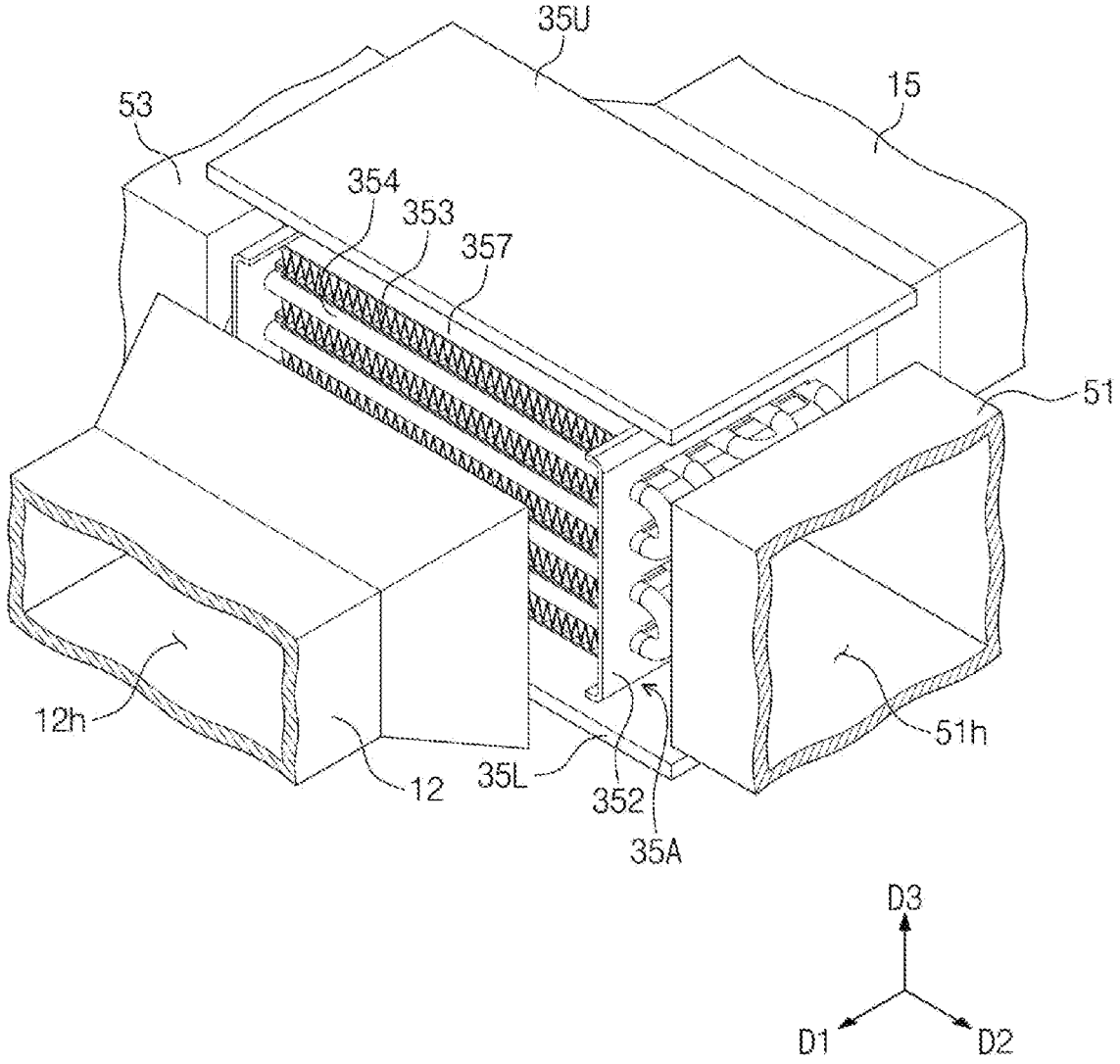
FIG. 13 is an enlarged partial exploded perspective view illustrating some areas of FIG. 12.
Figure 14:
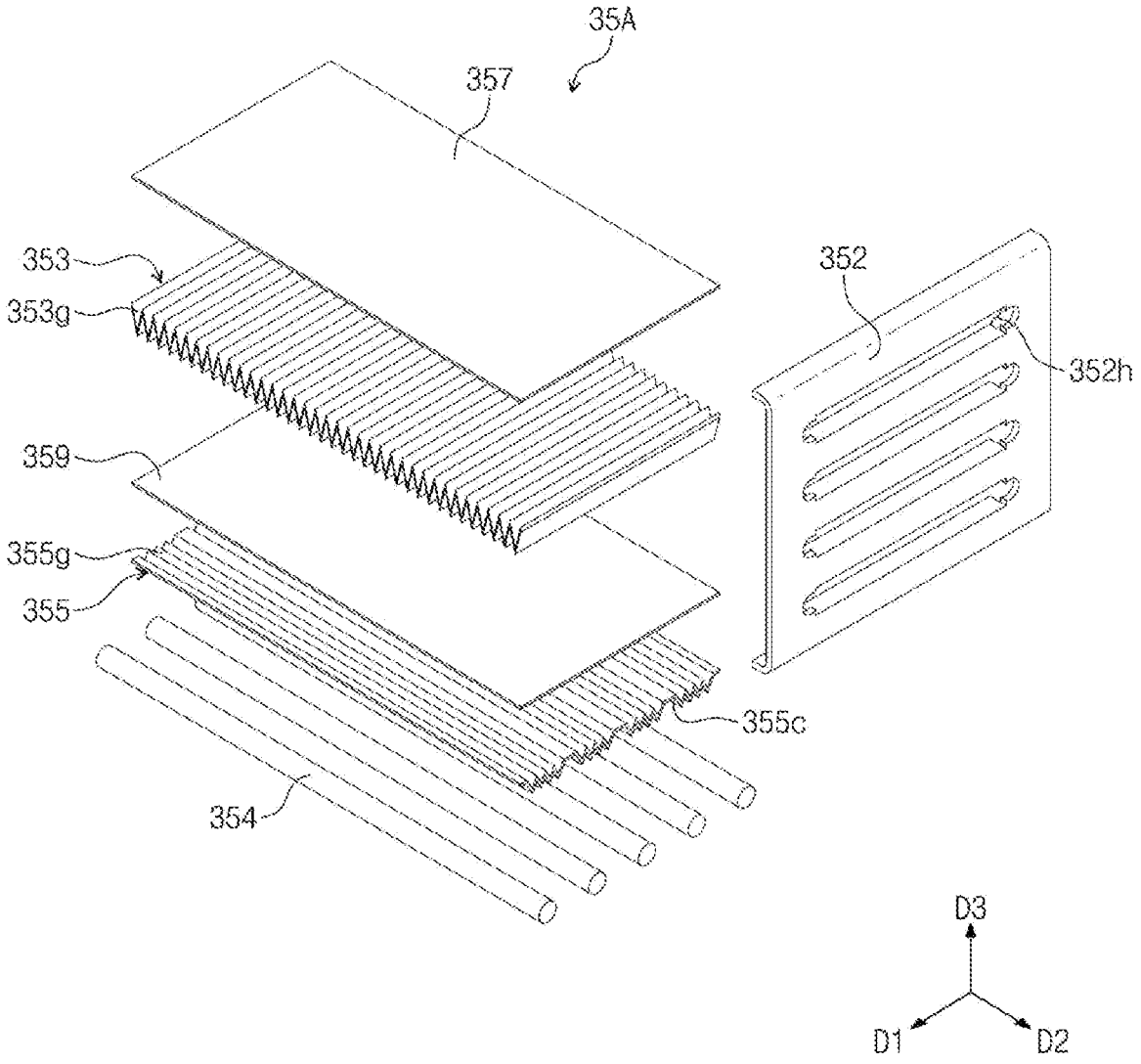
FIG. 14 is an enlarged exploded perspective view illustrating some components of FIG. 13.

FIG. 13 is an enlarged partial exploded perspective view illustrating some areas of FIG. 12, and FIG. 14 is an enlarged exploded perspective view illustrating some components of FIG. 13.

Referring to FIGS. 13 and 14, the second heat exchanger 35A may be surrounded by a second heat exchange duct 12, an outlet duct 15, an outdoor air inlet duct 51, an outdoor air outlet duct 53, an upper plate 35U, and a lower plate 35L.

The upper plate 35U may cover the second heat exchanger 35A from above. More specifically, the upper plate 35U may cover an upper side of the second heat exchanger 35A that is surrounded by the second heat exchange duct 12, the outlet duct 15, the outdoor air inlet duct 51, and the outdoor air outlet duct 53, to isolate the second heat exchanger 35A from the outside.

The lower plate 35L may support the second heat exchanger 35A from below. More specifically, the lower plate 35L may cover a lower side of the second heat exchanger 35A that is surrounded by the second heat exchange duct 12, the outlet duct 15, the outdoor air inlet duct 51, and the outdoor air outlet duct 53, to isolate the second heat exchanger 35A from the outside.

The second heat exchanger 35A may include a heat exchange refrigerant pipe 354, a side plate 352, a circulation path connector 353, an outdoor air cooling path connector 355, a first separation plate 357, and a second separation plate 359.

The heat exchange refrigerant pipe 354 may be connected to the refrigerant pipe (39 in FIG. 12). A refrigerant passing through the compressor (33 in FIG. 12) may move along the refrigerant pipe 39 and enter the heat exchange refrigerant pipe 354. The refrigerant in the heat exchange refrigerant pipe 354 may release heat to the surroundings. That is, when the refrigerant releases heat toward the heat exchange refrigerant pipe 354, the heat exchange refrigerant pipe 354 may release heat to the surroundings. More specifically, the heat released from the refrigerant may be transferred to the surroundings through the heat exchange refrigerant pipe 354, the circulation path connector 353, the outdoor air cooling path connector 355, the first separation plate 357, and the second separation plate 359. The refrigerant may be condensed while releasing heat in the heat exchange refrigerant pipe 354.

The side plate 352 may cover side surfaces of the heat exchange refrigerant pipe 354, the circulation path connector 353, the outdoor air cooling path connector 355, the first separation plate 357, and the second separation plate 359. The side plate 352 may secure and support such components. The side plate 352 may provide a side through-hole 352*h*. The side through-hole 352*h* may allow the heat exchange refrigerant pipe 354 to be connected to the refrigerant pipe (39 in FIG. 12). In addition, the side through-hole 352*h* may allow the outdoor air inlet path 51*h* and the outdoor air outlet path (53*h* in FIG. 11) to be connected to the inner space of the second heat exchanger 35A. The side plate 352 may be provided in plural. For example, the side plate 352 may be provided as two side plates 352. The two side plates 352 may be disposed to face each other.

The circulation path connector 353 may provide a first path groove 353*g*. The first path groove 353*g* may extend in the first direction D1. The first path groove 353*g* may connect the second heat exchange path 12*h* to the outlet path (15*h* in FIG. 11). The first path groove 353*g* between the second heat exchange path 12*h* and the outlet path 15*h* may be considered a part of the circulation path (10Ah in FIG. 11). Accordingly, the circulation path 10Ah passes through the second heat exchanger 35A in the first direction D1. The first path groove 353*g* may be provided in plural. The plurality of first path grooves 353*g* may be spaced apart from each other in the second direction D2. In addition, the first path groove 353*g* may be provided on both the upper side and the lower side of the circulation path connector 353. The first path groove 353*g* formed on the upper side of the circulation path connector 353 and the first path groove 353*g* formed on the lower side of the circulation path connector 353 may be disposed to alternate with each other. In this case, the circulation path connector 353 may have a serpentine plate shape as shown in FIG. 14.

The outdoor air cooling path connector 355 may provide a second path groove 355*g* and a refrigerant pipe groove 355*c*. The second path groove 355*g* may extend in the second direction D2. The second path groove 355*g* may connect the outdoor air inlet path 51*h* to the outdoor air outlet path (53*h* in FIG. 11). The second path groove 355*g* between the outdoor air inlet path 51*h* and the outdoor air outlet path 53*h* may be considered a part of the outdoor air cooling path 50Ah. Accordingly, the outdoor air cooling path 50Ah passes through the second heat exchanger 35A in the second direction D2. The second path groove 355*g* may be provided in plural. The plurality of second path grooves 355*g* may be spaced apart from each other in the first direction D1. In addition, the second path groove 355*g* may be provided on both the upper side and the lower side of the outdoor air cooling path connector 355. The second path groove 355*g* formed on the upper side of the outdoor air cooling path connector 355 and the second path groove 355*g* formed on the lower side of the outdoor air cooling path connector 355 may be disposed to alternate with each other. In this case, the outdoor air cooling path connector 355 may have a serpentine plate shape as shown in FIG. 14. The refrigerant pipe groove 355*c* may extend in the second direction D2. Each of the width and/or height of the refrigerant pipe groove 355*c* may be larger than that of the width and/or height of the second path groove 355*g*. The heat exchange refrigerant pipe 354 may be disposed in the refrigerant pipe groove 355*c*. Although the refrigerant pipe groove 355*c* is illustrated as being provided on the lower side of the outdoor air cooling path connector 355, the disclosure is not limited thereto. That is, the refrigerant pipe groove 355*c* may be provided even on the upper side of the outdoor air cooling path connector 355. The refrigerant pipe groove 355*c* may be provided in plural. The plurality of refrigerant pipe grooves 355*c* may be spaced apart from each other in the first direction D1.

The first separation plate 357 may cover the upper side of the circulation path connector 353. The second separation plate 359 may cover the lower side of the circulation path connector 353. More specifically, the second separation plate 359 may be disposed between the circulation path connector 353 and the outdoor air cooling path connector 355.

As illustrated in FIG. 14, the heat exchange refrigerant pipe 354, the second separation plate 359, the outdoor air cooling path connector 355, the circulation path connector 353, and the first separation plate 357 may be sequentially stacked in a layered structure. The layered structure may be repeated several times. In a state in which a plurality of components are stacked, the side plates 352 may be inserted on the both sides to fix and support the layered structure.

As described with reference to FIGS. 13 and 14, the outdoor air cooling path connector 355 and the circulation path connector 353 may be stacked in the upper and lower direction. The first separation plate 357 and the second separation plate 359 may be inserted between the outdoor air cooling path connector 355 and the circulation path connector 353 in the layered structure, so that the connection between the first path groove 353*g* and the second path groove 355*g* may be blocked. In addition, the connection between the first path groove 353*g* and the second path groove 355*g* may be blocked also by the side plate 352. An external air current entering the second heat exchanger 35A along the outdoor air cooling path (50Ah in FIG. 11) may move along the second path groove 355*g*. The internal air current entering the second heat exchanger 35A along the circulation path (10Ah in FIG. 11) may move along the first path groove 353*g*. Therefore, the external air current entering the second heat exchanger 35A along the outdoor air cooling path 50Ah and the internal air current entering the second heat exchanger 35A along the circulation path 10Ah may not be mixed with each other. That is, the first separation plate 357 and the second separation plate 359 are inserted between the outdoor air cooling path connector 355 and the circulation path connector 353, so that the external air current on the outdoor air cooling path 50Ah and the internal air current on the circulation path 10Ah may simultaneously flow without mixing with each other. In addition, because the heat exchange refrigerant pipe 354 is inserted between the outdoor air cooling path connector 355 and the circulation path connector 353, the external air current moving along the outdoor air cooling path 50Ah and/or the internal air current moving along the circulation path 10Ah may exchange heat with the heat exchange refrigerant pipe 354. Furthermore, the heat exchange refrigerant pipe 354 is disposed to extend in the second direction D2, so that the internal air current is prevented from flowing into the second path groove 355*g*, and thus odor is prevented from leaking to the outside.

Figure 15A:
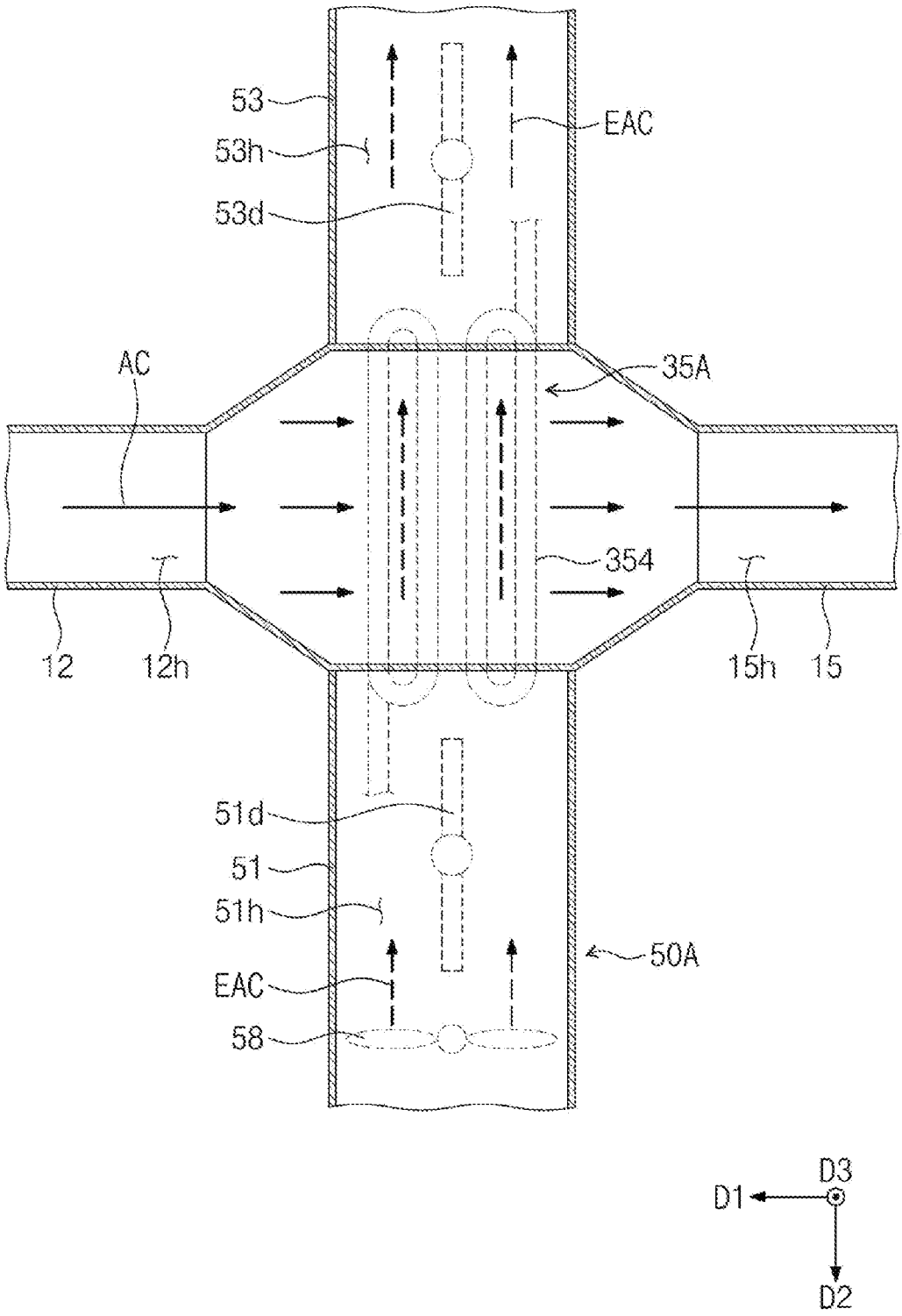
FIG. 15A is a plan view of some areas of FIG. 12.
Figure 15B:
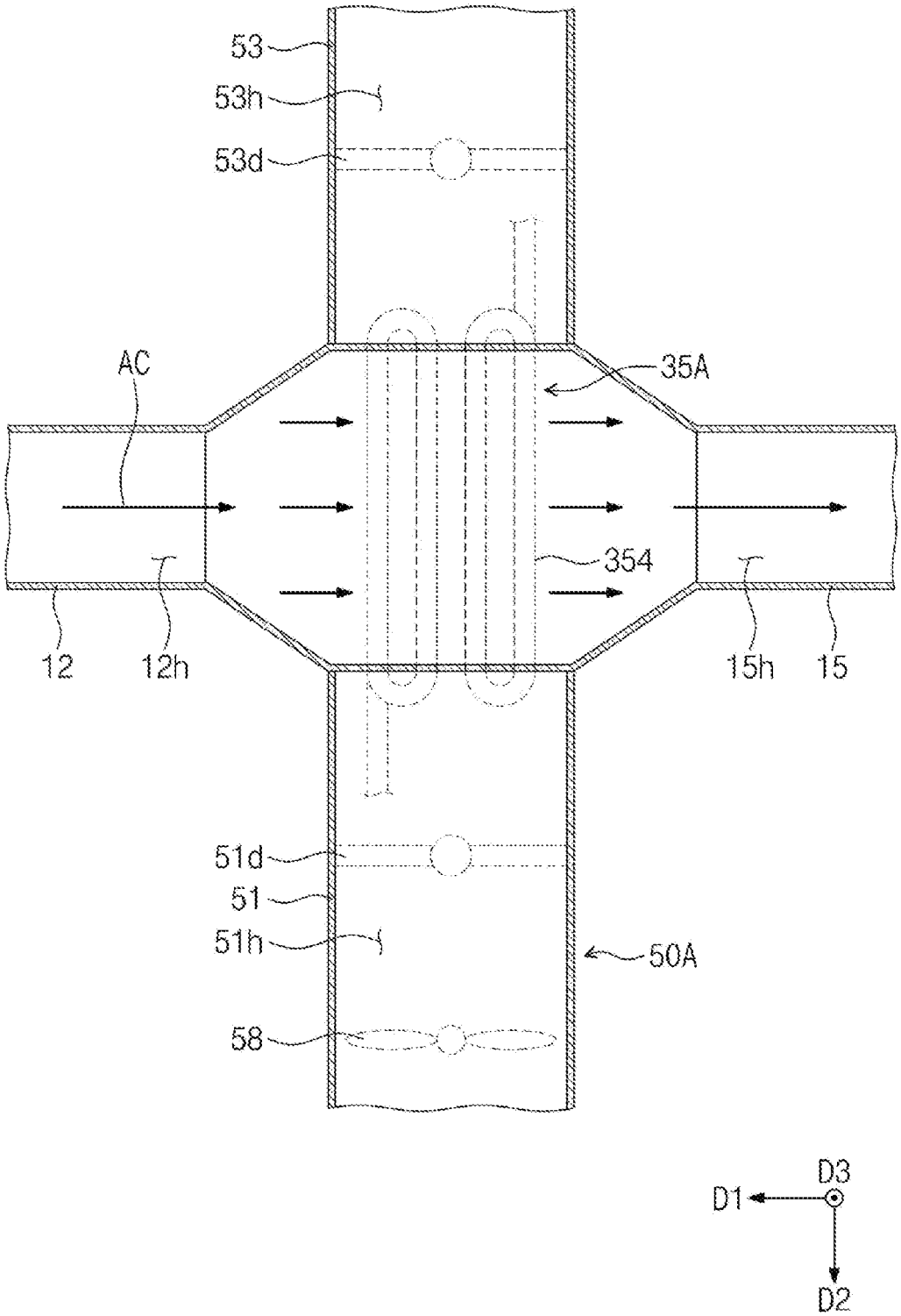
FIG. 15B is a plan view of some areas of FIG. 12.

FIG. 15A is a plan view of some areas of FIG. 12 and FIG. 15B is a plan view of some areas of FIG. 12.

Referring to FIG. 15A, in the first dehumidifying mode, the controller (C in FIG. 11) may open the first outdoor air damper 51*d* and the second outdoor air damper 53*d*. Alternatively, in the second dehumidifying mode, the controller C, in a state in which the first outdoor air damper 51*d* and the second outdoor air damper 53*d* are already open, may start the operation of the outdoor air cooling blower 58. Alternatively, without the first outdoor air damper 51*d* and the second outdoor air damper 53*d*, the controller C may only start driving the outdoor air cooling blower 58. Accordingly, an external air current EAC may be generated in the outdoor air cooling path 50Ah. Accordingly, outdoor air cooling of the heat exchange refrigerant pipe 354 in the second heat exchanger 35A may be performed. The cooling of the heat exchange refrigerant pipe 354 in the second heat exchanger 35A may be performed by the external air current EAC on the outdoor air cooling path 50Ah. Heat transfer from the heat exchange refrigerant pipe 354 to the internal air current AC moving along the circulation path 10Ah may be weak or absent. Accordingly, the temperature of the internal air current AC on the circulation path 10Ah passed through the second heat exchanger 35A may not rise or may rise slightly. Accordingly, low-temperature and low-humidity air may be provided to the accommodation space (SH in FIG. 11).

Referring to FIG. 15B, in the second dehumidifying mode, the controller (C in FIG. 11) may close the first outdoor air damper 51*d* and the second outdoor air damper 53*d*. Alternatively, in the second dehumidifying mode, the controller C may stop the operation of the outdoor air cooling blower 58 in a state in which the first outdoor air damper 51*d* and the second outdoor air damper 53*d* are open. Alternatively, without the first outdoor air damper 51*d* and the second outdoor air damper 53*d*, the controller C may only stop the driving of the outdoor air cooling blower 58. Accordingly, an external air current may not be formed in the outdoor air cooling path 50Ah. Accordingly, the outdoor air cooling of the heat exchange refrigerant pipe 354 of the second heat exchanger 35A may be stopped or only weak. The cooling of the heat exchange refrigerant pipe 354 in the second heat exchanger 35A may be performed by the internal air current AC moving along the circulation path 10Ah. Accordingly, the temperature of the internal air current AC on the circulation path 10Ah passed through the second heat exchanger 35A may increase. Accordingly, high-temperature and low-humidity air may be provided to the accommodation space (SH, see FIG. 11).

Figure 16:
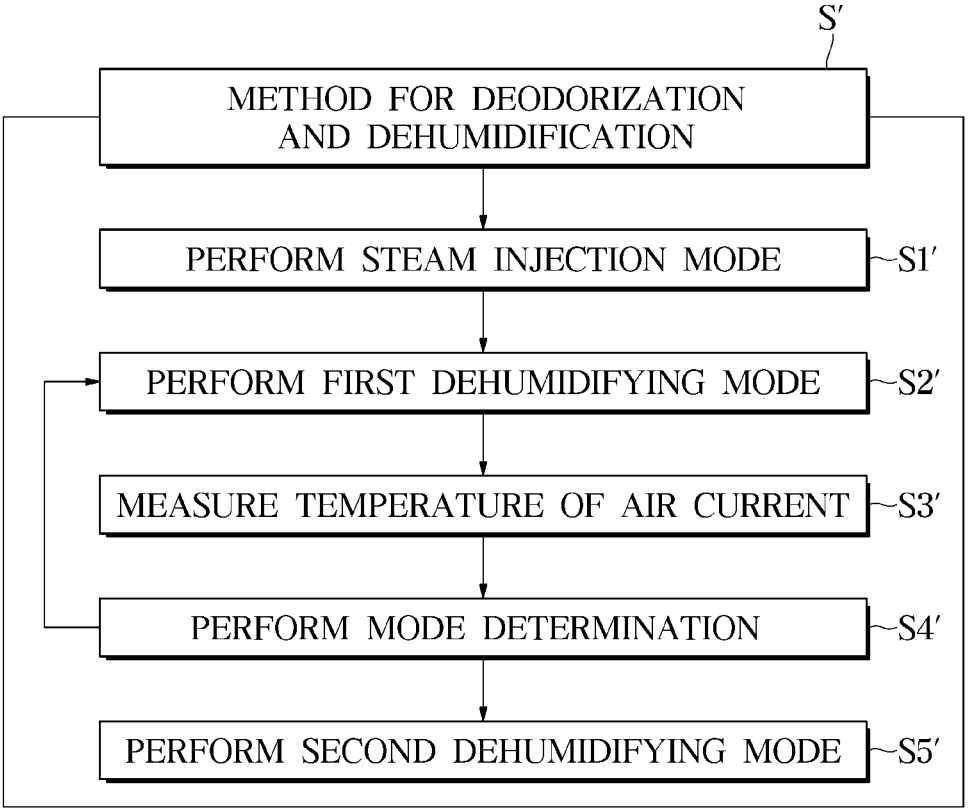
FIG. 16 is a flowchart of a dehumidification method using a dehumidification apparatus according to embodiments of the disclosure.

FIG. 16 is a flowchart of a dehumidification method using a dehumidification apparatus according to embodiments of the disclosure.

Referring to FIG. 16, a dehumidification method (S') may be provided. The dehumidification method (S') may be a method of caring for and storing shoes using a dehumidification apparatus. The dehumidification method (S') may include performing a steam injection mode (S1'), performing a first dehumidifying mode (S2'), measuring the temperature of an air current (S3'), performing mode determination (S4'), and performing a second dehumidifying mode (S5'). Hereinafter, each operation of the dehumidification method S' shown in FIG. 16 will be described with reference to FIGS. 11 to 15B.

The performing of the steam injection mode (S1') may be substantially the same as or similar to the performing of the steam injection mode (S1) described with reference to FIG. 10.

Referring to FIGS. 12, 15A and 16, the performing of the first dehumidifying mode (S2') may allow air in the accommodation space (SH, see FIG. 11) to move along the circulation path 10Ah of the air current circulator 10A and sequentially pass the first heat exchanger 31 and the second heat exchanger 35A. The internal air current on the circulation path 10Ah may pass through the second heat exchanger 35A and return to the accommodation space SH.

The performing of the first dehumidifying mode (S2') may further include cooling, by the controller (C in FIG. 11), the second heat exchanger 35A with an external air current using the outdoor air cooler 50A. That is, the outdoor air cooler 50A may be used to transport an external air current to the second heat exchanger 35A such that the second heat exchanger 35A is subject to outdoor air cooling. More specifically, the controller C may open the first outdoor air damper 51*d* and the second outdoor air damper 53*d* and/or operate the outdoor air cooling blower 58. Accordingly, outdoor air may enter the second heat exchanger 35A along the outdoor air inlet path 51*h*. The second heat exchanger 35A may release heat to the external air current. Accordingly, the second heat exchanger 35A may be cooled. The external air current, the temperature of which has risen by receiving heat from the second heat exchanger 35A, may escape to the outside along the outdoor air outlet path 53*h*.

In the performing of the first dehumidifying mode (S2'), the second heat exchanger 35A may be cooled by an external air current on the outdoor air cooling path 50Ah. Accordingly, the cooling effect by the internal air current on the circulation path 10Ah may be relatively weak. That is, the temperature of the internal air current on the circulation path 10Ah passed through the second heat exchanger 35A may be relatively low. The air supplied to the accommodation space SH may be relatively low in temperature and low in humidity.

Referring to FIG. 16, the measuring of the temperature of the air current (S3') may be substantially the same as or similar to the measuring of the temperature of the air current (S3) described with reference to FIG. 10. The mode identification (S4') may be substantially the same as or similar to the mode determination (S4) described with reference to FIG. 10.

Referring to FIGS. 12, 15B and 16, the performing of the second dehumidifying mode (S5') may include allow the air in the accommodation space (SH, see FIG. 11) to move along the circulation path 10Ah of the air current circulator 10A and sequentially pass through the first heat exchanger 31 and the second heat exchanger 35A. The internal air current on the circulation path 10Ah may pass through the second heat exchanger 35A and return to the accommodation space SH.

The performing of the second dehumidifying mode (S5') may further include stopping, by the controller (C in FIG. 11), the outdoor air cooling of the second heat exchanger 35A using the outdoor air cooler 50A. More specifically, the controller C may close the first outdoor air damper 51*d* and the second outdoor air damper 53*d* and/or stop the operation of the outdoor air cooling blower 58. Accordingly, an external air current in which outdoor air is directed toward the second heat exchanger 35A may not be generated. Accordingly, the outdoor air cooling for the second heat exchanger 35A using the external air current may be stopped.

In the performing of the second dehumidifying mode (S5'), the second heat exchanger 35A may be cooled by the internal air current on the circulation path 10Ah. The cooling effect by the external air current on the outdoor air cooling path 50Ah may be relatively weak or absent. Accordingly, the temperature of the internal air current on the circulation path 10Ah passed through the second heat exchanger 35A may be relatively high. The air provided to the accommodation space SH may be relatively high in temperature and low in humidity.

As is apparent from the above, the dehumidification apparatus according to the disclosure and the dehumidification method using the same can rapidly adjust the temperature of a dehumidified air current.

The dehumidification apparatus according to the disclosure and the dehumidification method using the same can adjust the dehumidifying temperature without controlling the output of the compressor.

The dehumidification apparatus according to the disclosure and the dehumidification method using the same can adjust the dehumidifying temperature while maintaining the dehumidifying performance above a certain level.

The dehumidification apparatus according to the disclosure and the dehumidification method using the same can prevent shoes from being damaged and shorten the stroke time by rapidly lowering the temperature in a storage compartment supplied with a high-temperature steam and removing moisture.

The effects of the disclosure are not limited to those described above, and other effects not described above will be clearly understood by those skilled in the art from the above detailed description.

Although few embodiments according to the disclosure have been shown and described, the above embodiment is illustrative purpose only, and it would be appreciated by those skilled in the art that changes and modifications may be made in these embodiments without departing from the principles and scope according to the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A dehumidification apparatus comprising:

a storage compartment configured to provide an accommodation space;

a circulation blower configured to form an internal air current flowing along a circulation path connected to the accommodation space;

a heat pump configured to exchange heat with the internal air current flowing along the circulation path;

an outdoor air cooler including an outdoor air cooling path and an outdoor damper disposed in the outdoor air cooling path, the outdoor air cooling path separate from the circulation path; and an air current diverter, wherein the heat pump includes:

a first heat exchanger configured to absorb heat from the internal air current; and a second heat exchanger configured to release heat to a surrounding, wherein the circulation path includes:

a first circulation path in which the internal air current passed through the first heat exchanger passes through the second heat exchanger and flow to the accommodation space; and a second circulation path in which the internal air current passed through the first heat exchanger bypasses the second heat exchanger and flow to the accommodation space, and wherein the air current diverter is configured to divert the circulation path from the first circulation path to the second circulation path, and wherein the outdoor air damper selectively opens when the air current diverter diverts the circulation path from the first circulation path to the second circulation path.

2. The dehumidification apparatus of claim 1, further comprising a steamer configured to inject a steam into the accommodation space.

3. The dehumidification apparatus of claim 1, further comprising a controller configured to control the air current diverter, wherein the controller is further configured to:

perform a first dehumidifying mode by controlling the air current diverter such that the internal air current is directed to the accommodation space along the second circulation path; and perform a second dehumidifying mode by controlling the air current diverter such that the internal air current is directed to the accommodation space along the first circulation path.

4. The dehumidification apparatus of claim 3, wherein the air current diverter includes:

a first damper configured to selectively block a path connecting the first heat exchanger to the second heat exchanger; and a second damper configured to selectively block a path allowing the internal air current passed through the first heat exchanger to bypass the second heat exchanger, and wherein the controller is further configured to:

perform the first dehumidifying mode by controlling the air current diverter such that the first damper is closed and the second damper is opened; and perform the second dehumidifying mode by controlling the air current diverter such that the first damper is opened and the second damper is closed.

5. The dehumidification apparatus of claim 3, further comprising:

an outdoor air inlet path provided to allow the external air introduced from an outdoor space via the outdoor air damper to pass through the second heat exchanger and flow to an outside; and wherein the controller is further configured to control the outdoor air damper such that the outdoor air inlet path is opened during the first dehumidifying mode.

6. The dehumidification apparatus of claim 3, further comprising a temperature sensor configured to output a signal for detecting a temperature of the internal air current, wherein the controller is further configured to control the air current diverter based on the signal received from the temperature sensor.

7. The dehumidification apparatus of claim 6, wherein:

the temperature sensor is disposed between the second heat exchanger and the accommodation space on the circulation path, the controller is configured to:

detect a current temperature based on the signal received from the temperature sensor, compare the current temperature with a target temperature, and upon determining that the current temperature is higher than the target temperature, perform the first dehumidifying mode, and upon determining that the current temperature is lower than the target temperature, perform the second dehumidifying mode.

8. The dehumidification apparatus of claim 1, wherein:

the first heat exchanger is an evaporator, and the second heat exchanger is a condenser.

9. The dehumidification apparatus of claim 1, further comprising:

a first housing forming the accommodation space;

a fixer located on an inner surface of the first housing; and a shoe support detachably mounted on the fixer.

10. The dehumidification apparatus of claim 9, wherein:

the shoe support further includes a hanger on which a shoe is held, the fixer is provided with an air current connection hole connected to the circulation path, and the hanger includes an outlet port through which air supplied through the air current connection hole is discharged.

11. A dehumidification apparatus comprising:

a storage compartment forming an accommodation space;

a circulation blower configured to form an internal air current flowing along a circulation path connected to the accommodation space;

a heat pump configured to exchange heat with the internal air current moving along the circulation path, and includes an evaporator, a compressor, a condenser, an expansion valve, and a refrigerant pipe;

an outdoor cooling blower configured to form an external air current in an outdoor air cooling path separate from the circulation path and connected to an outdoor space;

an air current diverter;

an outdoor air damper disposed in the outdoor air cooling path; and a controller configured to control the outdoor air cooling blower, wherein the internal air current introduced from the accommodation space sequentially passes through the evaporator and the condenser along the circulation path and returns to the accommodation space, and wherein the controller is configured to select and perform at least one of:

a first dehumidifying mode in which the external air current is transferred to the condenser to perform outdoor air cooling on the condenser; and a second dehumidifying mode in which the outdoor air cooling on the condenser using the external air current is stopped, wherein the outdoor air damper selectively when the air current diverter diverts the circulation path from a first circulation path to a second circulation path.

12. The dehumidification apparatus of claim 11, further comprising a steamer configured to inject a steam to the accommodation space, wherein the controller is further configured to perform a steam injecting mode by controlling the steamer such that the steam is injected to the accommodation space.

13. The dehumidification apparatus of claim 11, wherein the controller is further configured to:

perform the first dehumidifying mode after a steam injecting mode is performed, and perform the second dehumidifying mode after the first dehumidifying mode is performed.

14. The dehumidification apparatus of claim 11, wherein the outdoor air cooling path is separate from and not connected to the circulation path.

15. The dehumidification apparatus of claim 14, wherein:

the circulation path passes through the condenser in a first direction, and the outdoor air cooling path passes through the condenser in a second direction crossing the first direction.

16. The dehumidification apparatus of claim 11, wherein the controller is further configured to open the outdoor air damper in the first dehumidifying mode.

17. The dehumidification apparatus of claim 11, further comprising:

a first housing forming the accommodation space;

a fixer located on an inner surface of the first housing; and a shoe support detachably mounted on the fixer.

18. The dehumidification apparatus of claim 17, wherein:

the shoe support further includes a hanger on which a shoe is held, the fixer is provided with an air current connection hole connected to the circulation path, and the hanger includes an outlet port through which air supplied through the air current connection hole is discharged.

* * * * *